US010669849B2

(12) United States Patent
Ravencroft et al.

(10) Patent No.: US 10,669,849 B2
(45) **Date of Patent: *Jun. 2, 2020**

(54) ROCK ANCHOR INFLATION AND DRAINING SYSTEM

(71) Applicant: Nevada Industrial LLC, Sparks, NV (US)

(72) Inventors: Chris Ravencroft, Reno, NV (US); Dwight Peabody, Craig, AK (US)

(73) Assignee: Nevada Industrial LLC, Sparks, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/172,210

(22) Filed: Oct. 26, 2018

(65) Prior Publication Data

US 2019/0211675 A1 Jul. 11, 2019

Related U.S. Application Data

(63) Continuation-in-part of application No. 15/920,403, filed on Mar. 13, 2018, now Pat. No. 10,267,148.

(60) Provisional application No. 62/681,523, filed on Jun. 6, 2018, provisional application No. 62/614,050, filed on Jan. 5, 2018.

(51) Int. Cl.
*E21D 20/02* (2006.01)
*E21D 21/00* (2006.01)

(52) U.S. Cl.
CPC ..... *E21D 21/0073* (2016.01); *E21D 20/028* (2013.01); *E21D 21/0033* (2013.01); *E21D 21/0093* (2013.01)

(58) Field of Classification Search
CPC ..... E21D 21/0073; E21D 21/0033; E21D 20/028
See application file for complete search history.

(56) References Cited

U.S. PATENT DOCUMENTS 4,140,429 A * 2/1979 Herbst ..... E02D 5/76 405/259.6
4,423,986 A * 1/1984 Skogberg ..... E21D 20/00 405/259.1
4,511,289 A * 4/1985 Herron ..... E21D 20/00 405/259.1

(Continued)

FOREIGN PATENT DOCUMENTS

CA 2893814 A1 * 6/2014 ..... E21D 20/028
WO WO2011087946 7/2011

OTHER PUBLICATIONS

International Search Report and Written Opinion, PCT/US18/66068, dated Mar. 29, 2019, 9 pages.

*Primary Examiner* — Frederick L Lagman
(74) *Attorney, Agent, or Firm* — Brownstein Hyatt Farber Schreck, LLP

(57) ABSTRACT

Rock anchors, inflation chucks, and inflation systems such as those described herein, allow for substantially complete draining of fluids from interior volumes of the rock anchors. In various situations, corrosive fluids may be introduced to the rock anchor, including inflating the rock anchors and during normal use, such as by groundwater intrusion. The inflation chucks described herein include multiple inflation paths for more effectively introducing and draining fluid from rock anchors during inflation processes and during general use.

18 Claims, 23 Drawing Sheets

(56) References Cited

U.S. PATENT DOCUMENTS

| | | | | |
|---|---|---|---|---|
| 4,974,689 | A * | 12/1990 | Issakainen | E21D 9/001 175/211 |
| 5,375,947 | A * | 12/1994 | Gouws | E21D 20/028 405/259.5 |
| 5,636,945 | A * | 6/1997 | Nes | E21D 21/0033 405/259.1 |
| 7,338,234 | B2 | 3/2008 | Rataj et al. | |
| 7,891,911 | B2 | 2/2011 | Tschemuth et al. | |
| 7,927,043 | B2 * | 4/2011 | Iwasaki | E21D 21/0006 405/259.3 |
| 7,963,725 | B2 | 6/2011 | Dawe | |
| 8,152,416 | B2 * | 4/2012 | Bureau | E21D 20/00 405/259.3 |
| 8,690,485 | B2 | 4/2014 | Smith | |
| 9,051,831 | B2 * | 6/2015 | Krekula | E21D 21/0033 |
| 9,062,547 | B2 | 6/2015 | Craven et al. | |
| 10,267,148 | B1 * | 4/2019 | Ravencroft | E21D 21/0073 |
| 2007/0081864 | A1 | 4/2007 | Iwasaki et al. | |
| 2007/0217869 | A1 * | 9/2007 | Dawe | E21D 21/004 405/259.4 |
| 2008/0110640 | A1 * | 5/2008 | Bernthaler | E02D 5/76 166/382 |
| 2009/0035071 | A1 * | 2/2009 | Tschernuth | E02D 5/805 405/259.3 |
| 2011/0070035 | A1 * | 3/2011 | Ricardo | E21D 20/02 405/259.5 |
| 2018/0066519 | A1 * | 3/2018 | Faulkner | E21D 20/028 |

* cited by examiner

ROCK ANCHOR INFLATION AND DRAINING SYSTEM

CROSS-REFERENCE TO RELATED APPLICATIONS

This application is a continuation-in-part of U.S. patent application Ser. No. 15/920,403, filed Mar. 13, 2018 and titled "SELF-DRAINING ROCK ANCHOR," now U.S. Pat. No. 10,267,148, issued Apr. 23, 2019, the disclosure of which is hereby incorporated herein by reference in its entirety. This application is a non-provisional patent application of and claims the benefit of U.S. Provisional Patent Application No. 62/614,050, filed Jan. 5, 2018 and titled "SELF-DRAINING ROCK ANCHOR," and U.S. Provisional Patent Application No. 62/681,523, filed Jun. 6, 2018 and titled "ROCK ANCHOR INFLATION AND DRAINING SYSTEM," and the disclosure of each is hereby incorporated herein by reference in its entirety.

FIELD

Embodiments described herein relate to inflatable rock anchor systems, and in particular, to systems for inflating and draining rock anchors.

BACKGROUND

Underground mining is widely used to excavate minerals and other materials from beneath the earth's surface. Underground mining is often performed in harsh environments, and mining equipment is regularly subjected to damaging conditions, including corrosive substances. The effects of these corrosive substances are particularly acute for equipment that is embedded in a mining application, since this type of equipment is often exposed to the harsh environment and unavailable for cleaning or inspection for extended periods of time. Furthermore, embedded mining equipment often provides structural support for a mine, so avoiding failure of this type of equipment is a priority.

SUMMARY

Certain embodiments described herein generally reference a method for expanding and draining an expandable rock anchor that includes the steps of inserting, at least partially into a borehole, a rock anchor having a first shape having a first diameter that is less than a diameter of the borehole, the rock anchor defining first and second openings to an interior volume of the rock anchor. The steps further include coupling an inflation system to the interior volume of the rock anchor using an inflation chuck. The steps further include introducing, by the inflation system, a first fluid into the interior volume, thereby causing the rock anchor to expand to a second shape having a second diameter that is greater than the first diameter and substantially equal to the diameter of the borehole. The steps further include introducing, by the inflation system, a second fluid into the interior volume, thereby displacing the first fluid and draining substantially all of the first fluid from the interior volume via at least one of the first or second openings. The rock anchor maintains the second shape following the draining of substantially all of the first fluid from the interior volume, and an exterior surface of the expanded rock anchor engages with an interior surface of the borehole, thereby retaining the rock anchor in the borehole.

Other embodiments described generally relate to, include, or take the form of an inflation chuck for a rock anchor inflation system, including a housing defining an opening configured to receive a rock anchor that is configured to be inserted into a borehole and inflated to engage with an interior surface of the borehole. The housing further defines a first inflation path configured to fluidly couple to a first passage into an interior volume of the rock anchor and a second inflation path configured to fluidly couple to a second passage into the interior volume of the rock anchor.

Still other embodiments described reference inflation system for a rock anchor including a pump system configured to fluidly couple to an interior volume of a rock anchor to inflate and drain the rock anchor. The system further includes an inflation chuck configured to interface with the rock anchor and fluidly couple the interior volume of the rock anchor to the pump system. The inflation chuck defines an opening configured to receive an end of the rock anchor, a first inflation path fluidly coupled to a first passage into an interior volume of the rock anchor, and a second inflation path fluidly coupled to a second passage into an interior volume of the rock anchor. The pump system is configured to introduce a first fluid into the interior volume to inflate the rock anchor and introduce a second fluid into the interior volume to facilitate draining of the first fluid from the rock anchor.

BRIEF DESCRIPTION OF THE DRAWINGS

Reference will now be made to representative embodiments illustrated in the accompanying figures. It should be understood that the following descriptions are not intended to limit this disclosure to one preferred embodiment. To the contrary, the disclosure provided herein is intended to cover alternatives, modifications, and equivalents as may be included within the spirit and scope of the described embodiments, and as defined by the appended claims.

The use of the same or similar reference numerals in different figures indicates similar, related, or identical items.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Reference will now be made in detail to representative embodiments illustrated in the accompanying drawings. It should be understood that the following description is not intended to limit the embodiments to one preferred embodiment. To the contrary, it is intended to cover alternatives, modifications, and equivalents as can be included within the spirit and scope of the described embodiments as defined by the claims.

Rock excavations, including underground tunnels and other passageways, common in mining and other subterranean activities, can collapse. A collapse may harm people in and round the excavation and cause damage to equipment. As a result, some techniques and/or additional equipment may be used to support the rock excavations. Support structures can be inserted into ceilings and walls to strengthen them. For example, a tube-like structure may be inserted into a hole in the ceiling or wall and subsequently be expanded within the hole to add internal structural strength.

Figure 1A:
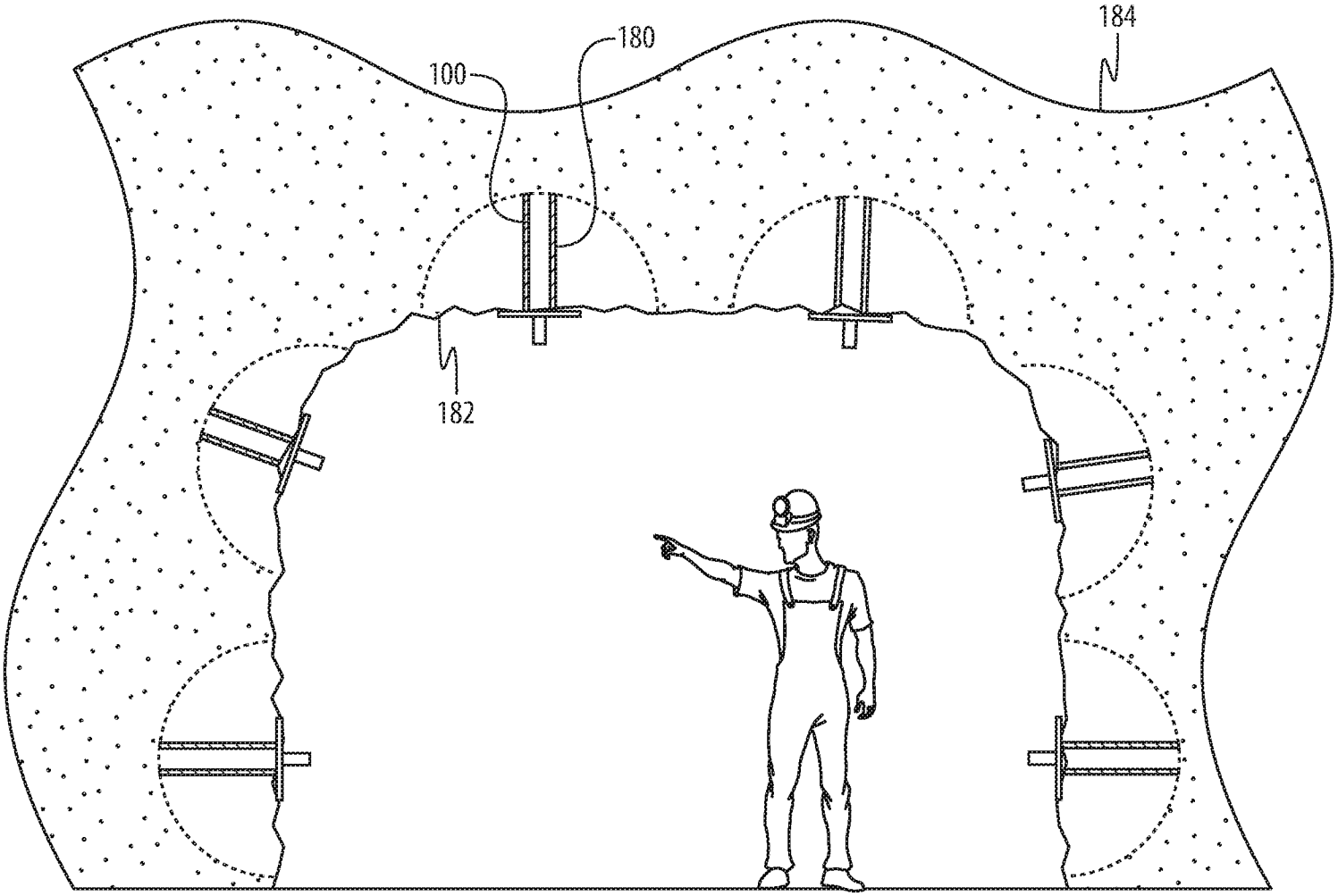
FIG. 1A illustrates a cutaway view of several rock anchors 100 in use in an underground mining environment.

Rock anchors (e.g., rock bolts, anchor bolts, and the like), such as those described herein, are used for stabilizing rock excavations, such as mines. In various embodiments, expandable rock anchors may be inserted into a cavity (e.g., a borehole) in a rock structure or other mass and are inflated (e.g., expanded) by introducing an inflation fluid to an interior volume of the rock anchor. As used herein, "inflation fluid" may include any suitable fluid (e.g., liquid or gas) that may be used to inflate a rock anchor 100. Example inflation fluids include water, air, specialized fluids for rock anchor inflation, and/or other fluids. FIG. 1A illustrates a cutaway view of several rock anchors 100 in use in an underground mining environment. Each rock anchor 100 is disposed in a cavity 180 (e.g., a borehole, a shaft, a pit, or the like) in a mass 184. The cavity 180 extends from a surface of the mass 184 into the mass. The inflation of the rock anchor 100 causes the exterior surface of the rock anchor to engage with the interior surface of the cavity 180, thereby securing or retaining the rock anchor 100 in the cavity 180. For example, inflation of the rock anchor 100 may cause the exterior surface of the rock anchor to apply a compressive (e.g., outward) force on the interior surface of the cavity 180. Additionally or alternatively, the inflation of the rock anchor may cause a washer 190 disposed around the rock anchor to exert an inward force on a surface of the mass, thereby structurally stabilizing the mass. In various embodiments, force(s) exerted by the rock anchors 100 contribute to increased structural stability of the mass 184.

The mass 184 may be any substantially solid material or combination or conglomerate of materials, including rock, soil, ice, sand, concrete, and so on. In some embodiments, the surface 182 of the mass 184 is a rock structure, such as a wall or ceiling in a tunnel. The mass 184 may be above or below ground level. In some embodiments, the mass 184 is a wall of a tunnel in an underground mine. The rock anchor 100 may be formed of any suitable material or combination of materials, including metal, polymers, composites, ceramics, and so on. In some embodiments, the rock anchor 100 is formed of steel. The rock anchor 100 may further include various treatments, coatings, and/or linings to improve performance in its application.

In certain applications, the inflation fluids that are introduced to the rock anchor 100 are corrosive to the rock anchor. Similarly, while the rock anchor 100 is disposed in the mass 184, it may be exposed to additional corrosive substances, such as groundwater and other corrosive fluids. These corrosive substances may intrude into the interior volume of the rock anchor 100.

In conventional solutions, substantial amounts of inflation fluids and other damaging intruded substances may remain in the rock anchors for extended periods of time, and as a result, corrode or otherwise damage the rock anchor. For example, the inflation fluid may be water (e.g., groundwater) with corrosive properties that, if left in contact with the rock anchor, leads to corrosion or other damage to the rock anchor. This may affect the structural properties of the rock anchor, such as making it more prone to failure and requiring it to be removed from its application prematurely.

The rock anchors and rock anchor systems described herein allow for substantially complete draining of fluids, including inflation fluids and intruded substances, from their interior volumes. The rock anchor systems include inflation chucks that are configured to interface with (e.g., contact) rock anchors during inflation and/or draining processes. The rock anchors include multiple passages into the interior volume for more effectively introducing and draining fluid from the rock anchors during or after inflation processes and during normal use. The inflation chucks described herein may include multiple inflation paths for introducing multiple fluids into the rock anchors.

In some instances, draining occurs as a result of decoupling an inflation system from the rock anchor and/or coupling on the interior volume with an ambient environment, for example as discussed below with respect to FIG. 8. In some instances, the inflation system includes functionality for draining the rock anchors, for example as discussed below with respect to FIGS. 9-12.

Figure 1B:
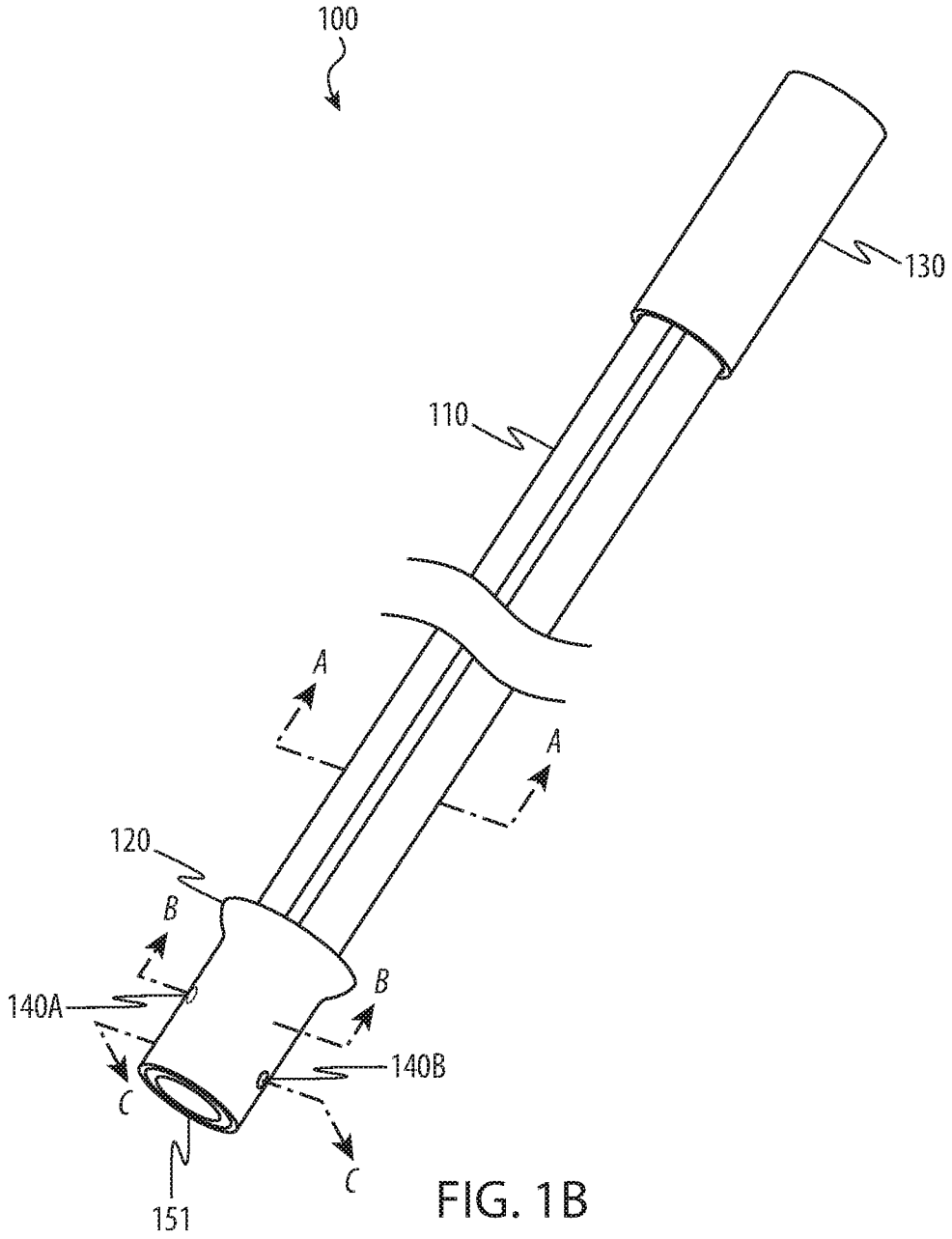
FIG. 1B illustrates an example rock anchor in an unexpanded configuration.
Figure 1C:
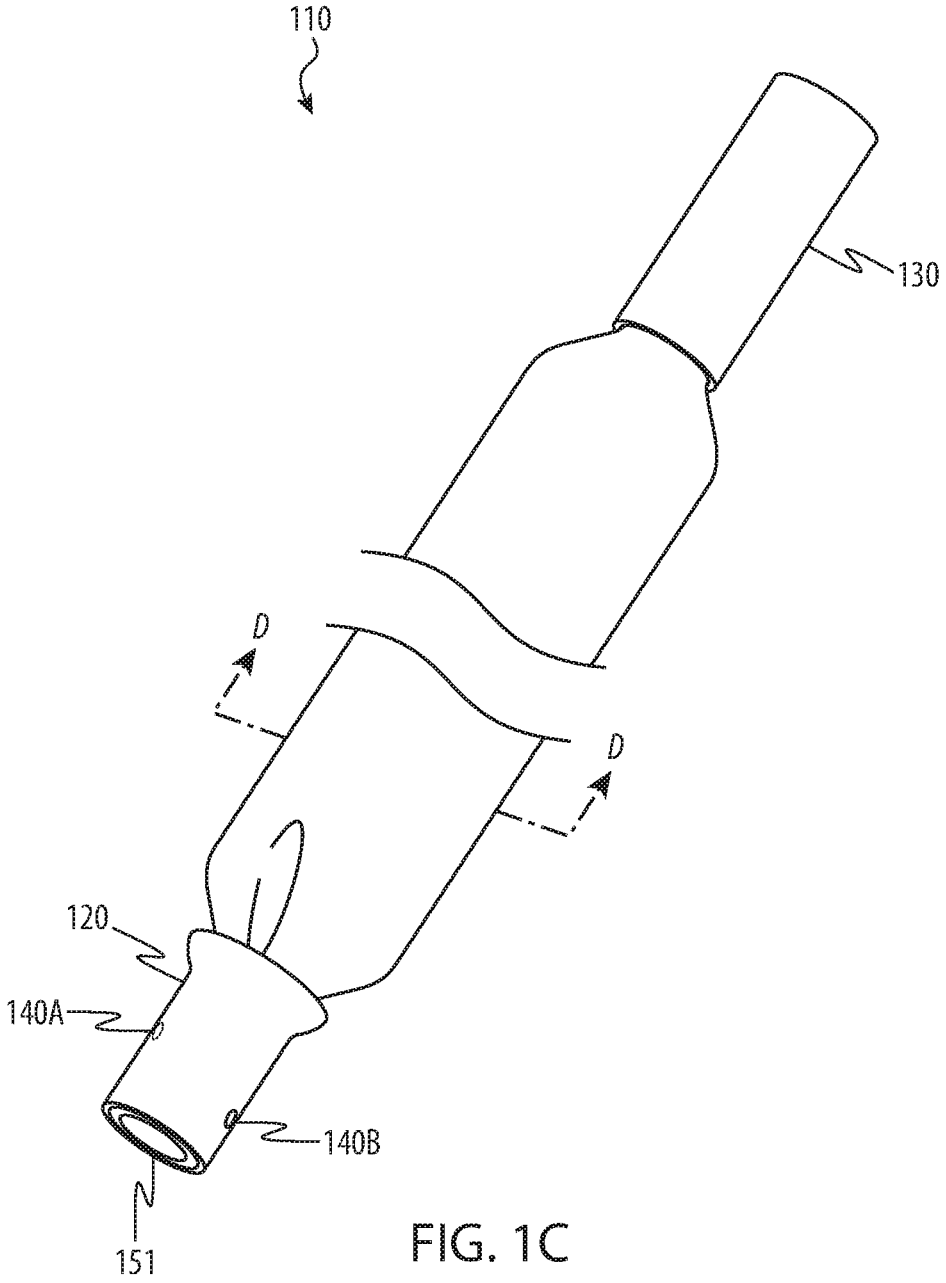
FIG. 1C illustrates the example rock anchor in an expanded configuration.

FIG. 1B illustrates an example rock anchor 100 in an unexpanded configuration. FIG. 1C illustrates the example rock anchor 100 in an expanded configuration. Referring to FIG. 1B, the rock anchor 100 includes an anchor body 110, a bushing 120, and an end cap 130. In some embodiments, the anchor body 110 is an elongate member having a first shape (e.g., a "folded tube" shape) in the unexpanded configuration and a different shape (e.g., partially cylindrical) in the expanded configuration, and the bushing 120 and the end cap 130 are disposed at opposite ends of the anchor body 110. The bushing 120 and/or the end cap 130 may be fixedly disposed around a portion of the end of the anchor body 110. The rock anchor 100 defines passages 140A and 140B that extend from the exterior of the rock anchor 100 into one or more interior volumes. In various embodiments, the passages 140A and 140B may be used to introduce an inflation fluid into the interior volume(s), thereby causing the anchor body to expand, such as to the expanded configuration of FIG. 1C.

The passages 140A and 140B may also be used to drain inflation fluids and/or other fluids from the interior volume (s), such as while the rock anchor 100 is disposed in a cavity 180 as shown in FIG. 1A. In various embodiments, having two or more passages 140 enables substantially all of the inflation fluid and/or other fluids to be drained from the interior volume. This may reduce corrosion within the rock anchor 100, and thereby reduces the risk of structural weakening and other disadvantages associated with maintaining fluids in the interior volume.

As shown in FIG. 1B, the rock anchor 100 may include sealed ends (e.g., sealed end 151). In some embodiments, the sealed ends are sealed by welding the anchor body 110 to the bushing 120, for example as shown by sealed end 151 in FIG. 1B. Similarly, a second sealed end of the rock anchor 100 (not shown in FIG. 1B) may be sealed by welding the anchor body 110 to the end cap 130. In various embodiments, the sealed ends may be sealed using a variety of techniques and/or materials, including crimping, welding, plugging, gluing, cementing, melting, and so on. In some embodiments, as a result of the sealed ends, the passages 140 are the only openings to the interior volume(s) of the anchor body.

Figure 2A:
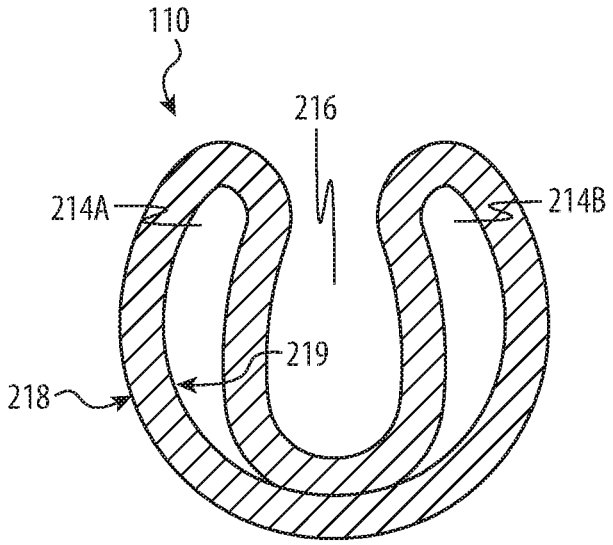
FIG. 2A is a cross-section of an anchor body in an unexpanded configuration, along section line A-A of FIG. 1B.

FIG. 2A is a cross-section of the anchor body 110 in an unexpanded configuration, along section line A-A of FIG. 1B. The anchor body 110 comprises a sidewall 212 that defines an exterior surface 218 and an interior surface 219. In some embodiments, the exterior and interior surfaces are continuous around the entire anchor body 110.

FIG. 2A illustrates the folded tube shape of the anchor body 110. The sidewall 212 forms a crease 216 that separates the inside of the anchor body 110 into two interior volumes 214A and 214B. The folded tube shape may be formed from a tubular member by forming the crease 216 along a side of the tubular member. In some embodiments, the folded tube shape may be formed by extruding the folded tube shape directly. As shown in FIG. 2A, in some embodiments, the interior surface 219 of the sidewall 212 touches the interior surface 219 of the opposing side of the sidewall 212 such that the interior volumes are physically separated and not in fluid communication. In some embodiments, the surfaces of the sidewall 212 do not contact one another, and the interior volume is a single interior volume (e.g., the two interior volumes 214A and 214B are generally distinct from one another but are in fluid communication through a gap between the crease 216).

Figure 2B:
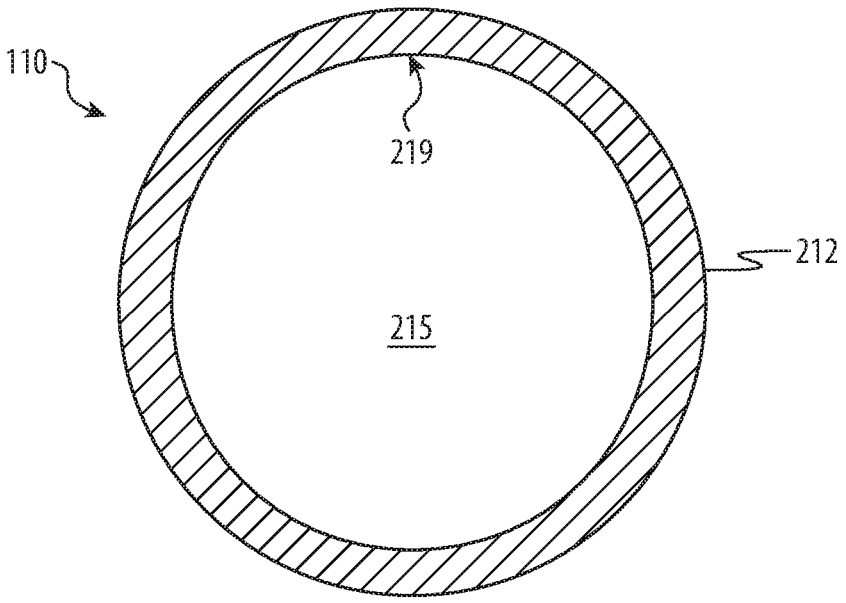
FIG. 2B is a cross-section of an anchor body in an expanded configuration, along section line D-D of FIG. 1C.

FIG. 2B is a cross-section of the anchor body 110 in an expanded configuration, along section line D-D of FIG. 1C. As illustrated in FIG. 2B, the expanded anchor body 110 has a substantially circular cross-section, and a single interior volume 215. As discussed above, the transition from the unexpanded configuration shown in FIG. 2A to the expanded configuration shown in FIG. 2B may be accomplished by the introduction of a pressurized gas or fluid within the interior volume that exerts a sufficient force on the interior surface 219 to expand the anchor body 110 radially outward from with respect to FIGS. 2A and 2B. As shown in FIGS. 2A and 2B, the diameter (e.g., the outer diameter) of the anchor body increases from a first shape having an unexpanded diameter in the unexpanded configuration to a second shape having an expanded diameter in the expanded configuration. In some embodiments, the diameter of the anchor body increases by at least 50%. In some embodiments, the diameter of the anchor body increases between 40% and 60%. In still other embodiments, the diameter of the anchor body increases between 20% and 100%. In various embodiments, the anchor body 110 maintains the second shape even after the inflation fluid is removed from the interior volume.

In some embodiments, the cross-sectional area of the single interior volume 215 of FIG. 2B is greater than the combined cross-sectional area of the interior volume(s) 214 of FIG. 2A. As a result, the volume of the interior volume 215 of FIG. 2B is greater than the combined volume of the interior volume(s) 214 of FIG. 2A.

FIG. 2B illustrates a substantially circular cross-section, however, the cross-section of the expanded anchor body 110 may have a different shape depending on various factors, including the shape of the cross-section in the unexpanded configuration, features of the cavity, and the like. For example, the expanded anchor body 110 may be deformed by features of the cavity (e.g., features of wall(s) defining the cavity) and may at least partially conform to irregularities in the cavity. When the anchor body 110 is deformed by features of the cavity, it may increase the structural engagement between the anchor and the mass.

Figure 3:
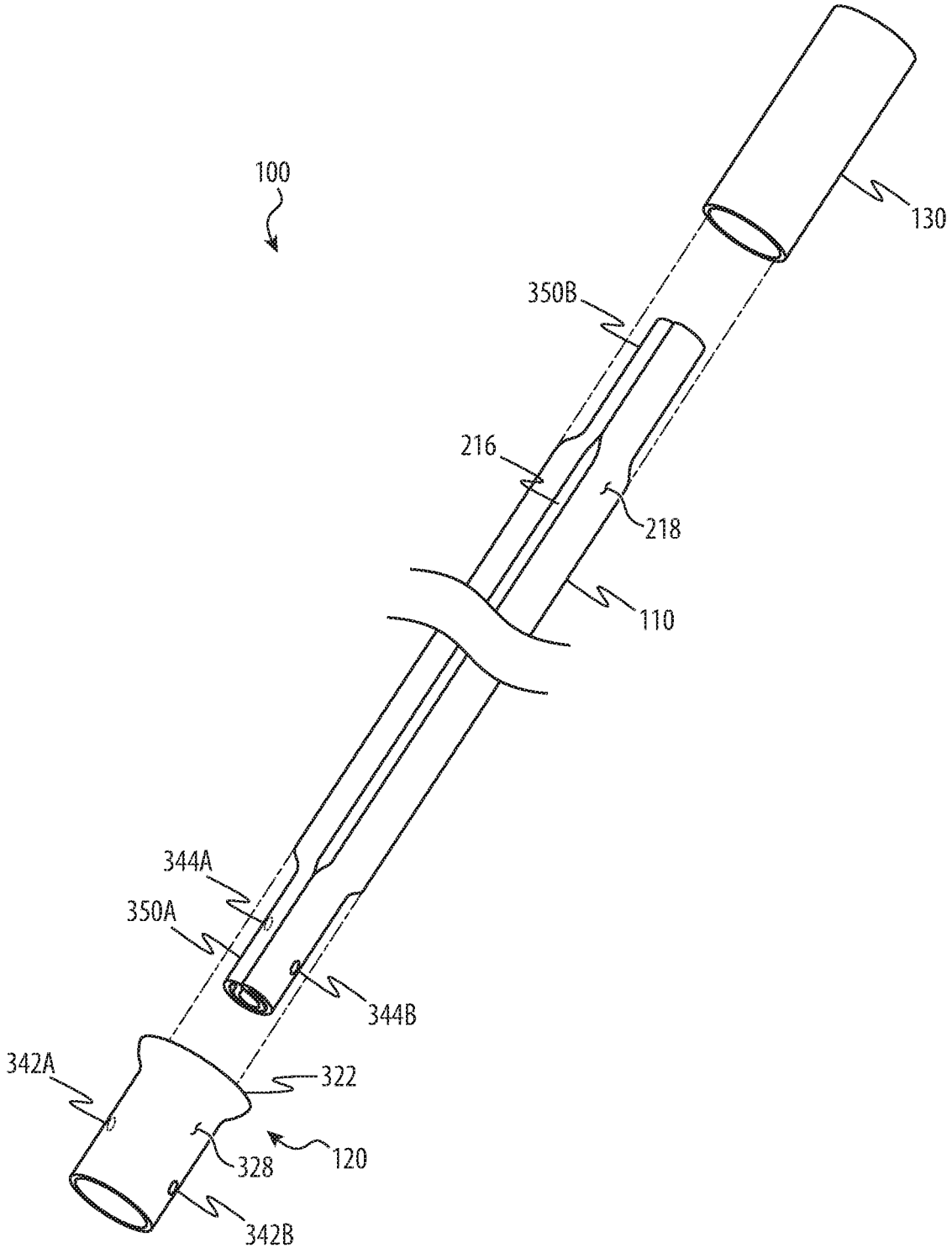
FIG. 3 illustrates an exploded view of a rock anchor in an unexpanded configuration.

FIG. 3 illustrates an exploded view of the rock anchor 100 in an unexpanded configuration. The anchor body 110 defines two or more openings (e.g., openings 344A and 344B) that are formed in the anchor body 110 and extend from the exterior surface 218 of the anchor body, through the sidewall 212 and into the interior volume(s) of the anchor body. The bushing 120 defines two or more openings (e.g., openings 342A and 342B) that are formed in the bushing 120 and extend from an exterior surface 328 of the bushing to an interior surface (not shown) of the bushing. (The exterior surface 328 of the bushing may correspond to a cylindrical surface portion of the bushing.) In some embodiments, when the bushing 120 is secured to the anchor body 110, the openings 344 are aligned with the openings 342, thereby defining the passages 140 of the rock anchor 100 that were discussed above with respect to FIG. 1B. As shown in FIG. 3 and discussed in more detail below with respect to FIGS. 5A-5B, the passages 140 may have a longitudinal offset (e.g., positioned at different distances from the end of the rock anchor 100), as well as a radial offset (e.g., positioned at different radial positions around the circumference of the rock anchor 100).

As shown in FIG. 3, the end portions 350A and 350B of the anchor body 110 may be reduced in diameter compared to the rest of the anchor body 110. In some embodiments, the end portions 350 are crimped or otherwise reduced in diameter. In various embodiments, the reduced diameter of the end portions 350 of the anchor body 110 allows the end portions of to fit inside the bushing 120 and the end cap 130.

In some embodiments, an end of the bushing 120 defines a lip 322. The exterior diameter and/or the interior diameter of the bushing may increase along a portion of the length of the bushing. The lip 322 may be configured to interface with a washer during use of the rock anchor 100, as discussed in more detail below with respect to FIGS. 6A-6B.

In some embodiments, the bushing 120 is between 2.5 and 10 centimeters (1 and 4 inches) in length and between 1.2 and 7.5 centimeters (0.5 and 3 inches) in width. In some embodiments, the bushing is 5.9 centimeters (2.3 inches) long and 3 centimeters (1.2 inches) wide. In some embodiments, the rock anchor 100 is between 1.5 and 4.5 meters (5 and 15 feet) long, but it may be longer or shorter. In some embodiments, the rock anchor is 2.4 meters (8 feet) long. In some embodiments, the anchor body has a diameter between 1.2 and 7.5 centimeters (0.5 and 3 inches) in the unexpanded configuration and between 5 and 12.5 centimeters (2 and 5 inches) in the expanded configuration. In some embodiments, the anchor body diameter is 2.5 centimeters (1 inch) in the unexpanded configuration and 5 centimeters (2 inches) in the expanded configuration. The dimensions described in this section and elsewhere herein are for example purposes only. In practice, the described elements may be larger or smaller than described. In some embodiments, any value or measurement expressed herein may have a margin of error (e.g., plus-or-minus 5 percent), and need not be exact.

In some embodiments, the end cap 130 and/or the bushing 120 reinforce the sealed ends 151. For example, the end cap 130 and/or the bushing 120 may exert a force on the anchor body 110 that keep the surfaces of the sidewall pressed together, thus maintaining the seal.

Figure 4A:
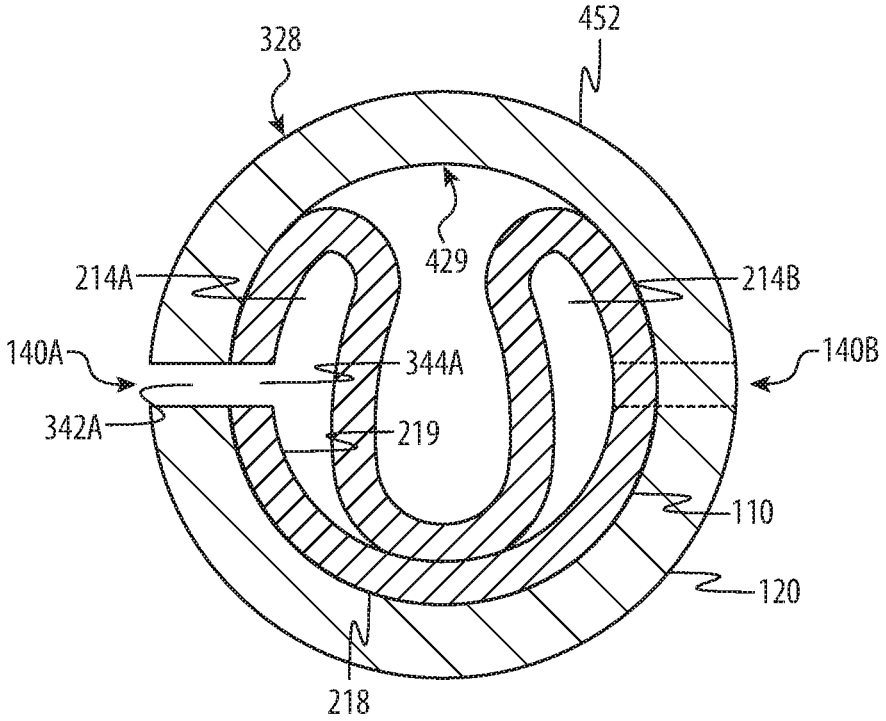
FIG. 4A is a cross-section of a rock anchor having two passages, along section line B-B of FIG. 1B.

FIG. 4A is a cross-section of the rock anchor 100, along section line B-B of FIG. 1B, according to an embodiment. FIG. 4A illustrates the bushing 120 disposed around the anchor body 110. FIG. 4A illustrates the opening 342A and the opening 344A that together form the passage 140A. The passage 140A extends into the interior volume 214A from the exterior surface 328 of the bushing 120 to the interior surface 219 of the anchor body 110. In some embodiments, at least part of the interior surface 429 of the bushing 120 interfaces with at least part of the exterior surface 218 of the anchor body 110.

In some embodiments, such as the embodiment of FIG. 4A, the passage 140A has a radial offset of 180 degrees from the passage 140B (the position of which is shown using dashed lines) with respect to the exterior surface 328 of the bushing 120. In other embodiments, the radial offset between the passages may vary. In still other embodiments, the rock anchor 100 may include three or more passages 140 radially offset by various angles.

Figure 4B:
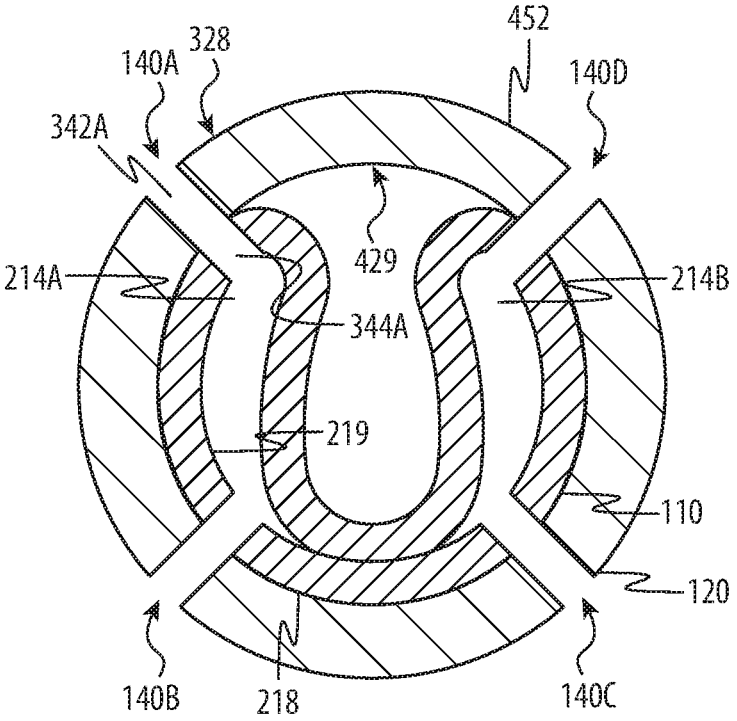
FIG. 4B is a cross-section of a rock anchor having four passages.

FIG. 4B is a cross-section of an embodiment of the rock anchor 100 having four passages 140. In some embodiments, such as the embodiment of FIG. 4B, the passages 140A-D are radially offset from one another around the rock anchor 100 by 90 degrees. In some embodiments, each of three passages 140 is offset by 120 degrees from the other two. Having two or more passages 140 provides an advantage during use of the rock anchor 100 by allowing substantially all fluid in the interior volume(s) to drain. For example, if the rock anchor 100 is oriented horizontally during use, having four passages 140 may allow at least one passage to be at or near a "bottom" side of the anchor, thereby facilitating draining by gravity.

The openings 344 and openings 342 may have the same shape and size (e.g., cross-sectional area) or may have different shapes and/or sizes from each other. For example, one or more openings 344 may have different shapes and/or sizes from other openings 344, and similarly, one or more openings 342 may have different shapes and/or sizes from other openings 344. Additionally, an opening 344 may have a different shape and/or size than the opening 342 with which it is aligned. The openings 344 and openings 342 may be formed using separate operations (e.g., drilled separately), or they may be formed by a single operation, (e.g., drilling through both the bushing 120 and the anchor body 110). As used herein, a passage may refer collectively to an opening 344 and a corresponding opening 342 that are aligned with one another.

The passages 140 may have a substantially circular cross-section (e.g., substantially cylindrical), or they may be shaped differently (e.g., rectangular, elliptical, irregular, or the like). The passages 140 (and the openings 344 and openings 342) may be formed using a variety of methods, including drilling, cutting, punching, tapping, boring, and so on. In some embodiments, the passages 140 are 3/16" diameter holes. In some embodiments, the passages 140 are between 0.2 and 0.8 centimeters (0.1 and 0.3 inches) in diameter. In some embodiments, the passages 140 are between 0.1 and 1.3 centimeters (0.05 and 0.5 inches) in diameter.

Figure 5A:
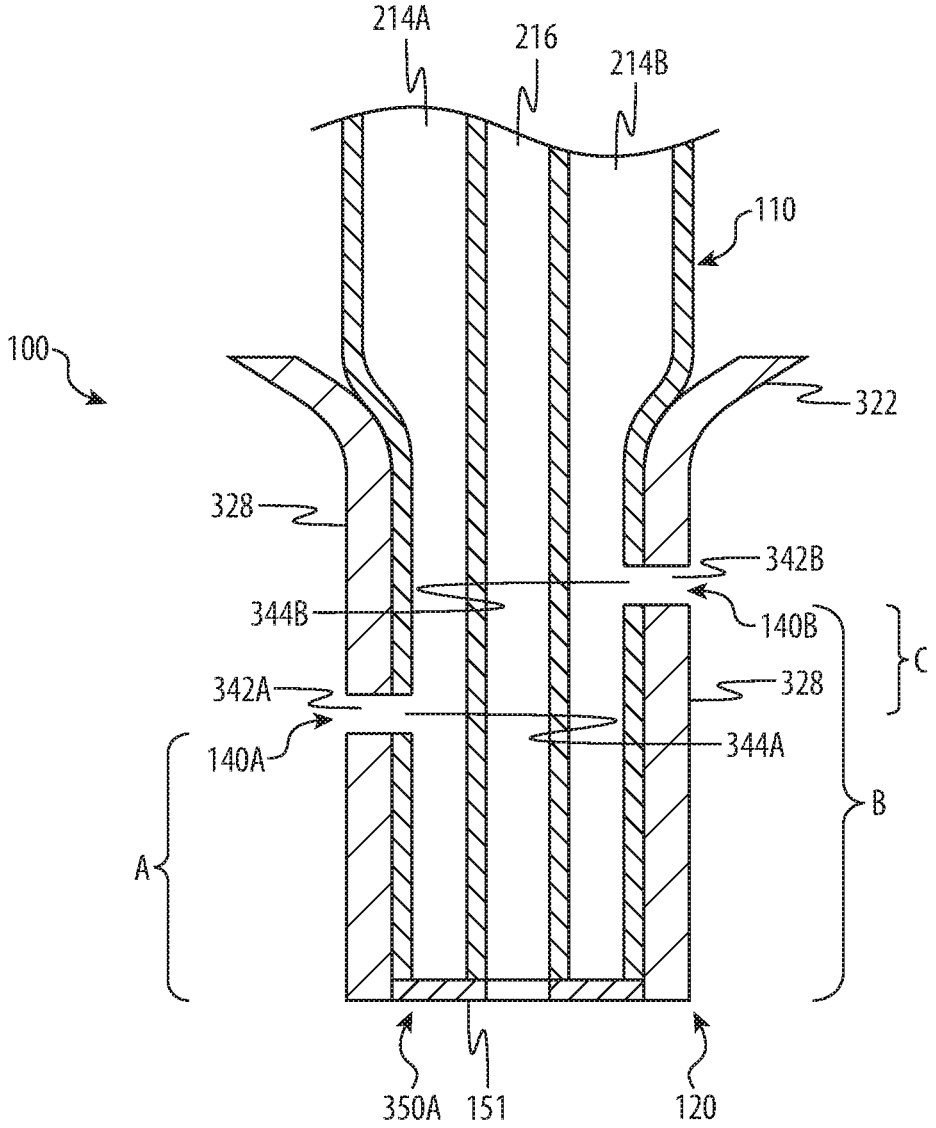
FIG. 5A is a cross-section of a portion of a rock anchor illustrating a longitudinal offset of the passages, along section line C-C of FIG. 1B.

FIG. 5A is a cross-section of a portion of the rock anchor 100 illustrating a longitudinal offset of the passages, along section line C-C of FIG. 1B. In some embodiments, such as the embodiment of FIG. 5A, the passages 140A and 140B have a longitudinal offset C in addition to the radial offset discussed above. The longitudinal offset c is defined by the passages 140 being different distances A and B from the bottom of the rock anchor 100 (with respect to FIG. 5A). In various embodiments, the longitudinal offset of the passages 140 provides better draining performance, including increasing the speed of draining and/or increasing the amount of fluid that may be drained from the rock anchor 100. In some embodiments, substantially all fluid may be drained from the rock anchor 100 using the passages 140. The longitudinal offset may allow air to more easily enter the interior volume during draining. For example, the longitudinal offset may allow air to enter one passage 140 while fluid exits the other passage 140. This helps to equalize the air pressure in the interior volume with the ambient environment more quickly, thereby lessening the vacuum effect of the lower-pressure air in the interior volume. This results in faster and more complete draining of the interior volume of the rock anchor.

In some embodiments, the passages have a longitudinal offset C of between 0.5 and 1 centimeters (0.2 and 0.4 inches). In some embodiments, the longitudinal offset C is 0.8 centimeters (0.3 inches). In some embodiments, the distance from the bottom of the rock anchor 100 to the passage 140A (e.g., distance a in FIG. 5A) is between 1.8 and 2 centimeters (0.7 and 0.8 inches). In some embodiments, distance A is 1.9 centimeters (0.75 inches). In some embodiments, the distance from the bottom of the rock anchor 100 to the passage 140B (e.g., distance b in FIG. 5A) is between 2.5 and 2.8 centimeters (1 and 1.1 inches). In some embodiments, distance B is 2.7 centimeters (1.06 inches).

Figure 5B:
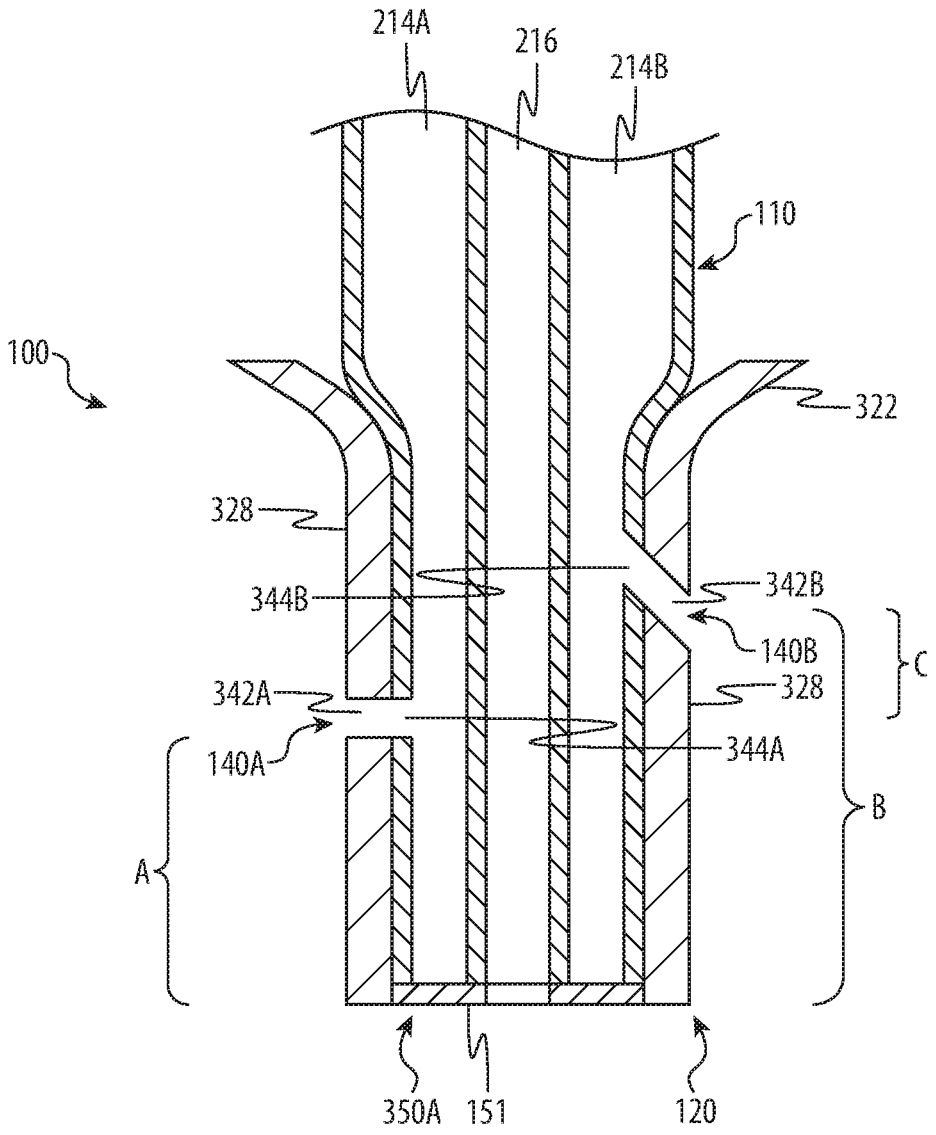
FIG. 5B is a cross-section of a portion of a rock anchor illustrating a non-perpendicular cylindrical axis, along section line C-C of FIG. 1B.

In some embodiments, as shown in FIG. 5A, a cylindrical axis passing through the center of a passage is substantially perpendicular to the exterior surface of the sidewall of the bushing 120 at the location of the passage. In some embodiments, the cylindrical axis is not perpendicular to the exterior surface of the sidewall of the bushing 120 and/or the sidewall of the anchor body 110. FIG. 5B is a cross-section of a portion of the rock anchor 100 illustrating a non-perpendicular cylindrical axis, along section line C-C of FIG. 1B. As shown in FIG. 5B, a cylindrical axis passing through the center of passage 140B is not perpendicular with respect to the sidewall of the bushing 120 and the sidewall of the anchor body 110. In some embodiments, the angle of the cylindrical axis relative to the exterior surface of the bushing 120 is between 10 and 80 degrees. In some embodiments, the angle is substantially equal to 45 degrees. The angle of the cylindrical axis of each passage 140 may differ from or be the same as one or more other passages 140. In various embodiments, non-perpendicular nature of one or more passages 140 provides better draining performance, including increasing the speed of draining and/or increasing the amount of fluid that may be drained from the rock anchor 100. In some embodiments, substantially all fluid may be drained from the rock anchor 100 using the passages 140.

As shown in FIGS. 5A and 5B, the anchor body 110 may be press-fit into the bushing 120. In various embodiments, the press-fit of the anchor body 110 into the bushing 120 forms a seal between the two components such that the passages 140 are sealed. In other embodiments, the anchor body 110 is coupled to the bushing 120 in a variety of ways, including, for example, welding, threaded connection, press fit, and/or adhesive. In some embodiments, the bushing 120 and the anchor body 110 may be formed as a single piece.

Figure 6A:
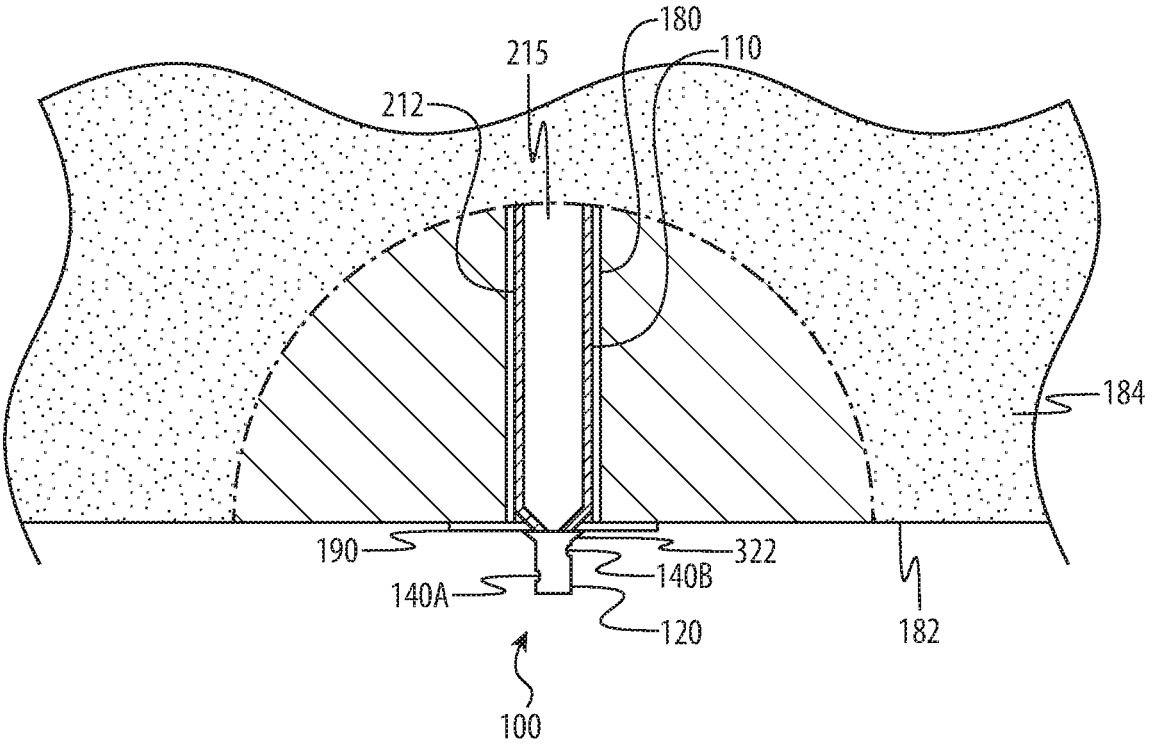
FIG. 6A illustrates a cutaway view of a rock anchor in an expanded configuration and disposed in a borehole in a vertical deployment.
Figure 6B:
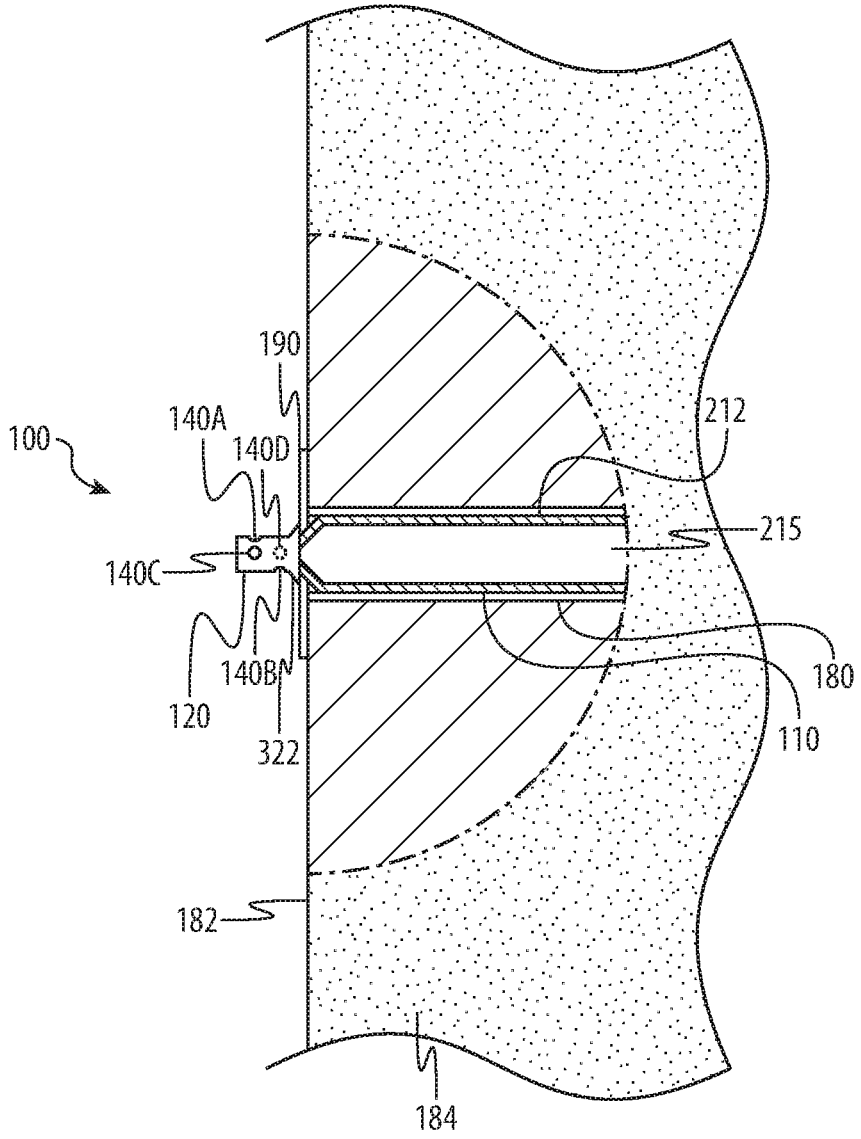
FIG. 6B illustrates a cutaway view of a rock anchor in an expanded configuration and disposed in a borehole in a horizontal deployment.

FIGS. 6A and 6B illustrate a cutaway views of the rock anchor 100 in the expanded configuration and disposed in a cavity 180. In FIG. 6A, the rock anchor 100 is shown in an expanded configuration in a cavity 180 of a mass 184, such as a rock structure. In some embodiments, such as the embodiment shown in FIG. 6A, the rock anchor 100 has been inserted into the cavity 180 in an unexpanded configuration and inflated to the expanded configuration shown, for example by the introduction of fluid (e.g., pressurized fluid) into the interior volume 215. As used herein, "pressurized fluid" may include a fluid having a pressure that is greater than an ambient or surrounding air pressure. As discussed above, the interior volume 215 may receive an inflation fluid via one or more passages 140, thereby causing the anchor body of the rock anchor to expand. In the expanded configuration shown in FIG. 6A, the sidewall 212 of the anchor body 110 contacts and engages with the interior surface of the cavity 180. The sidewall 212 exerts an outward force onto the interior surface of the cavity 180, thereby retaining or securing the rock anchor 100 in the cavity 180.

The rock anchor 100 includes a washer 190 disposed around the anchor body 110. The washer 190 is configured to contact a surface 182 of the mass 184 when the rock anchor 100 is in use. The bushing 120 is configured to interface with the washer 190. In some embodiments, the lip 322 of the bushing 120 interfaces with the washer 190 and keeps the washer 190 from sliding off the end of the rock anchor 100. In some embodiments, the bushing 120 exerts a force on the washer 190, and the washer 190, in turn, exerts a corresponding inward force on the surface 182 (e.g., upward with respect to FIG. 6A), thereby further securing the rock anchor 100 in the cavity 180. In various embodiments, the force(s) exerted by the washer 190 and the rock anchor 100 contribute to increased structural stability of the mass 184.

In some embodiments, the force exerted by the bushing 120 on the washer 190 is caused at least partially by a reduction in the overall length of the rock anchor 100 that occurs during expansion of the rock anchor. For example, the rock anchor 100 may have a first length in the unexpanded configuration and a shorter second length in the expanded configuration. This may result from the expansion of the anchor body of the rock anchor 100. In some embodiments, when the length of the rock anchor 100 is reduced during expansion, it causes the bushing 120 to be drawn toward the cavity 180, which may cause the bushing to exert the force on the washer 190, which in turn exerts the corresponding force on the surface 182 because the washer is disposed between the bushing and the surface.

In some embodiments, the diameter of the cavity 180 is substantially equal to the diameter of the anchor body 110 in the expanded configuration, which is greater than the diameter of the anchor body 110 in the unexpanded configuration. In some embodiments, the diameter of the cavity 180 is between 2.5 and 12.5 centimeters (1 and 5 inches). In some embodiments, the diameter of the cavity is 5 centimeters (2 inches).

As shown in FIG. 6A, the passages 140A and 140B have a longitudinal offset which results in the passage 140B being higher than the passage 140A. As discussed above, the longitudinal offset may allow air to more easily enter the interior volume 215 during draining, which results in faster and more complete draining of the interior volume of the rock anchor.

The rock anchor 100 in FIG. 6A is shown disposed in the mass 184 in a vertical deployment. In various embodiments, the rock anchor 100 may be disposed in the hole in a horizontal deployment, or at any angle between vertical and horizontal. FIG. 6B illustrates the rock anchor 100 in a horizontal deployment.

As shown in FIGS. 6A and 6B, a portion of the rock anchor 100 may protrude from the cavity 180. In various embodiments, one or more passages 140 are positioned on the protruding portion. In some embodiments, such as the embodiment of FIG. 6B, the rock anchor 100 includes four passages 140A-D having radial offsets of 90 degrees from one another. As illustrated in FIG. 6B, passages 140C and 140D are substantially level with one another. Without passages 140A and 140B, the position of the passages 140C-D may prevent the interior volume from draining substantially entirely because the passages are not at a lowest point (or otherwise a sufficiently low point to allow for substantially all of the fluid to be removed from the anchor) of the bushing 120. However, including passages 140A and 140B allows at least one passage to be at or close to the low point of the bushing 120. For example, in FIG. 6B, passage 140B is at or close to the low point of the bushing 120, which allows for substantially complete draining of the interior volume 215.

As described above, the rock anchor 100, including the anchor body 110, the bushing 120, the end cap 130, and the washer 190 may be formed of any suitable material or combination of materials, including metal, polymers, composites, ceramics, and so on. In some embodiments, the rock anchor 100 is formed of steel. The rock anchor 100 may further include various treatments, coatings, and/or linings to improve performance in its application.

Figure 7A:
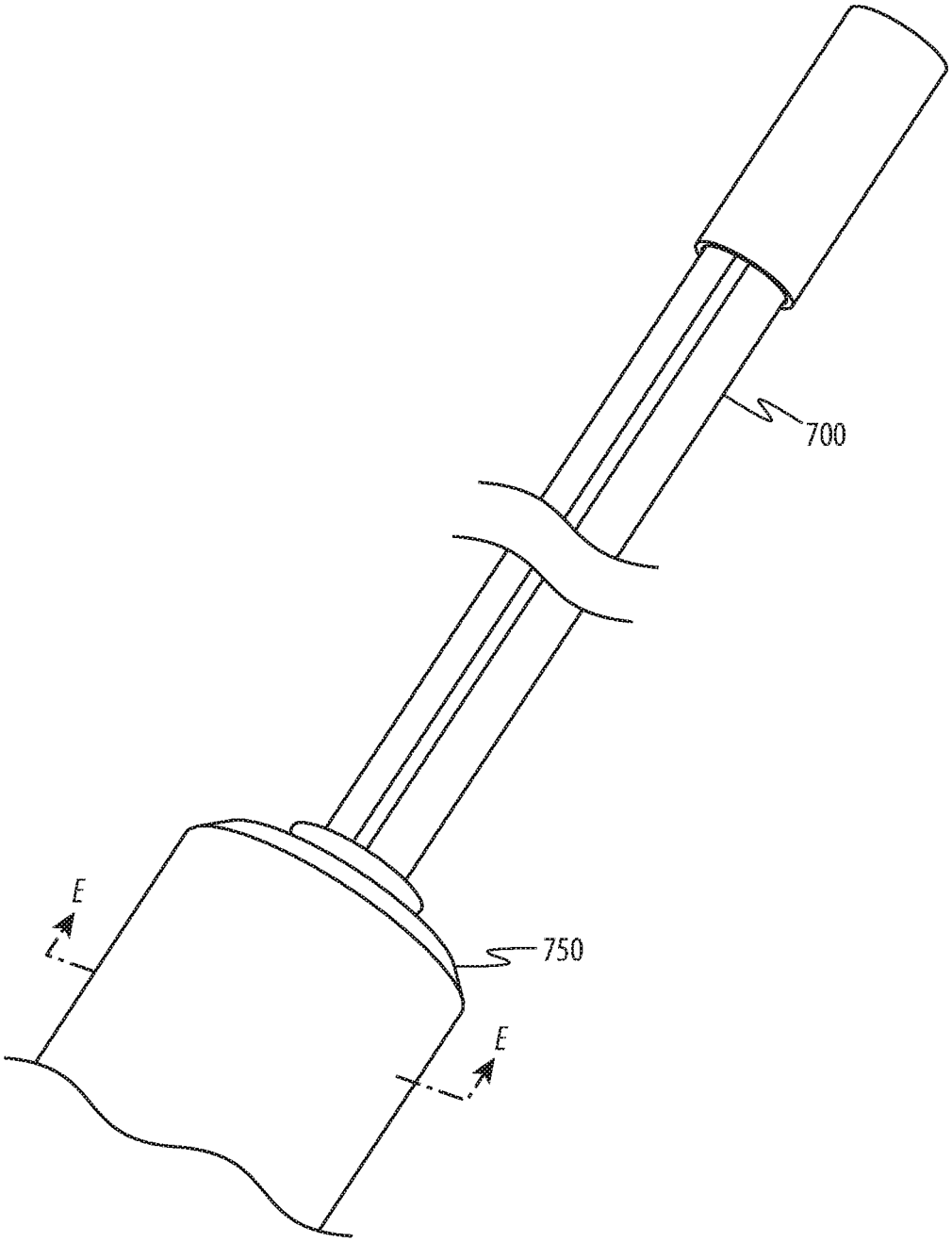
FIG. 7A illustrates an end of a rock anchor disposed in an inflation chuck.

FIG. 7A illustrates an end of a rock anchor 700 disposed in an inflation chuck 750. The rock anchor 700 is similar to the rock anchors discussed herein (e.g., rock anchor 100), and has similar features and components. The inflation chuck 750 is configured to introduce a fluid or gas (e.g., a pressurized fluid) into the rock anchor 700 (e.g., the interior volume) using the passages of the rock anchor 700. Positioning the end of the rock anchor 700 in the inflation chuck 750 may couple an inflation system to the interior volume of the rock anchor 700. As used in this context, coupling the inflation system to the interior volume may include any suitable method of connecting the inflation system and the interior volume such that the inflation system may introduce a fluid to the interior volume to inflate the rock anchor.

Figure 7B:
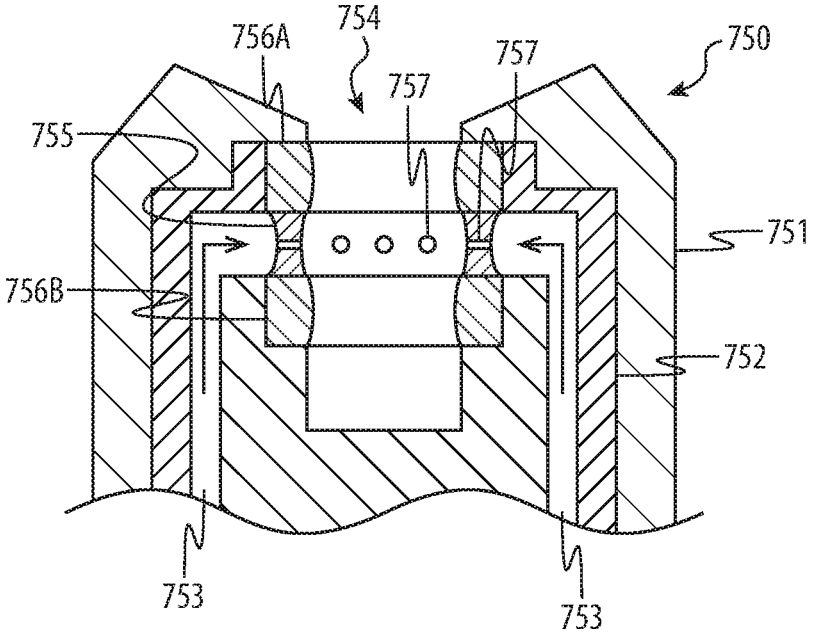
FIG. 7B is a cross-section of an inflation chuck, taken through section line E-E of FIG. 7A.

FIG. 7B is a cross-section of the inflation chuck 750 without the rock anchor 700, taken through section line E-E of FIG. 7A. The inflation chuck 750 includes a housing cover 751 that is disposed around an inner housing 752. The housing cover 751 and the inner housing 752 define an opening 754 that is configured to receive a portion of a rock anchor, such as a bushing. The inflation chuck further includes an inflation ring 755. The inflation ring 755 defines one or more openings 757 that fluidly couple the opening 754 to one or more inflation paths 753. The inflation chuck 750 further includes an upper gasket 756A and a lower gasket 756B. The gaskets 756 are configured to form a seal (e.g., a watertight seal, an airtight seal, etc.) around the inflation ring 755. In some embodiments, the gaskets and the rock anchor (e.g., the bushing) are self-sealing when a pressurized fluid is introduced, which may tend to increase the pressure between the gasket and the rock anchor and improve the seal therebetween.

Figure 7C:
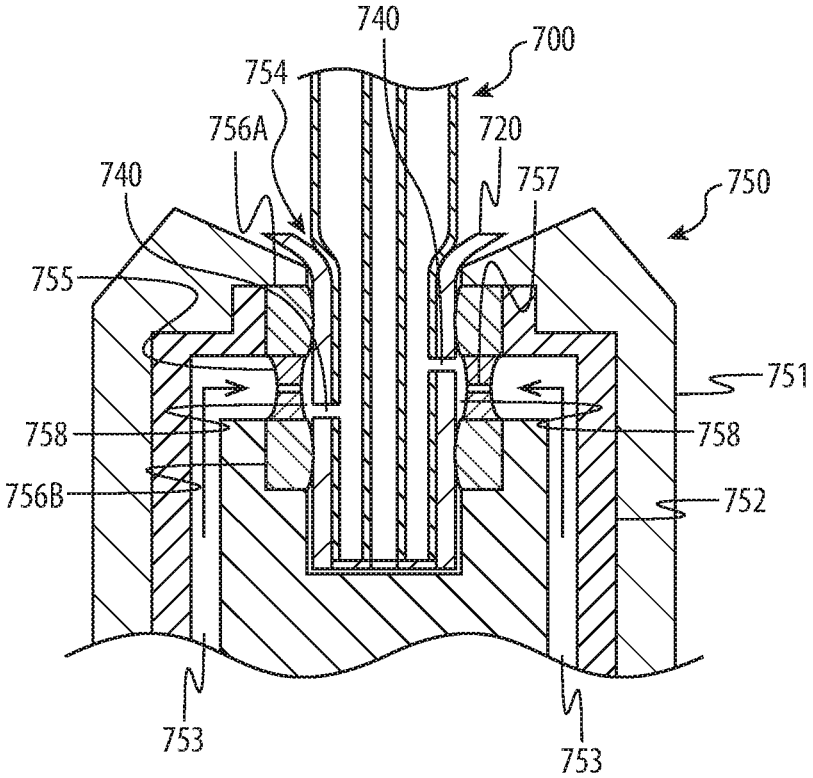
FIG. 7C is a cross-section of the inflation chuck and a portion of a rock anchor, taken through section line E-E of FIG. 7A.

FIG. 7C is a cross-section of the inflation chuck 750 and a portion of the rock anchor 700, taken through section line E-E of FIG. 7A. In an inflation configuration (e.g., during an inflation process), the bushing 720 is at least partially disposed within the opening 754 of the inflation chuck 750. The inflation ring 755 at least partially encircles the bushing 720 when the bushing 720 is disposed within the opening 754. At least one passage 740 of the rock anchor aligns (e.g., aligns vertically with respect to FIG. 7C) with the inflation ring 755 such that the inflation paths 753 are fluidly coupled to the interior volume of the rock anchor 700. The inflation chuck 750 introduces an inflation fluid into the interior volume of the rock anchor 700 via the inflation ring 755 and the passage(s) 740. The gaskets 756 compress against the bushing 720 to form a seal around the inflation ring 755 and create a void 758 within the inflation ring 755 and around the rock anchor 700. The inflation paths 753 carry an inflation fluid (e.g., pressurized fluid or gas) from an inflation device (e.g., a pump, a tank, compressor, or the like), through the openings 757 and into the void 758. The fluid or gas in the void flows into the rock anchor 700 via the one or more passages 740 that are aligned with the inflation ring. The inflation fluid is received in the interior volume, thereby causing expansion of the rock anchor.

After inflation, the inflation chuck 750 is removed from the rock anchor 700 and the rock anchor 700 is in a draining configuration. In some embodiments, in the draining configuration, the passages 740 couple the interior volume of the rock anchor 700 to the ambient environment, and the fluid or gas drains from the interior volume via the passages 740. In some embodiments, the draining occurs as a result of pressure release and/or gravity. As discussed above, in various embodiments, substantially all of the fluid or gas is drained from the rock anchor 700.

Figure 8:
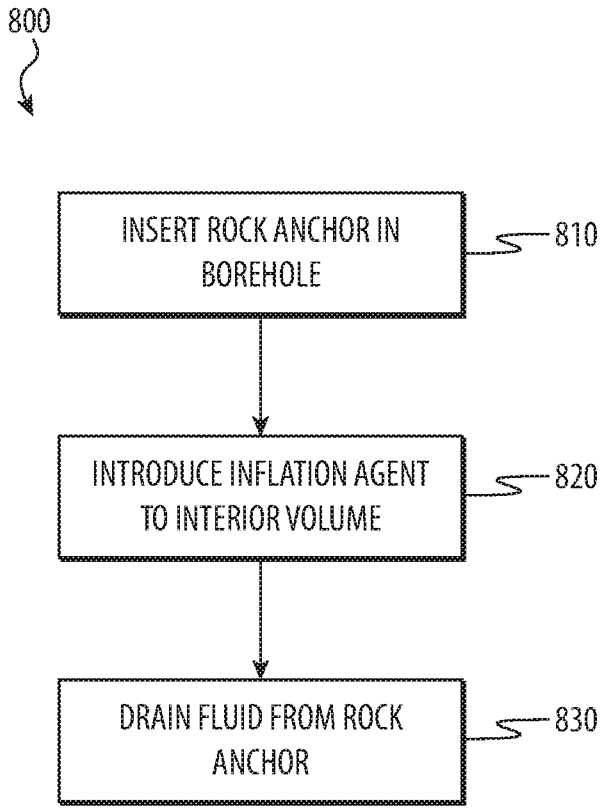
FIG. 8 is a simplified flow chart depicting an example process for inflating and draining a rock anchor.

FIG. 8 is a simplified flow chart depicting an example process 800 for inflating and draining a rock anchor. At step 810, the rock anchor is at least partially inserted in a cavity, such as a borehole in a rock structure, in an unexpanded configuration, in which the rock anchor has a first shape, such as a "folded tube" shape. In the unexpanded configuration, the rock anchor may have a diameter that is less than the diameter of the cavity. At step 820, an inflation fluid is introduced to the interior volume of the rock anchor. In some embodiments, introducing the inflation fluid includes coupling the interior volume to an inflation device via at least one passage in the rock anchor. For example, the interior volume may be coupled to an inflation system using an inflation chuck. As used in this context, coupling the inflation system to the interior volume may include any suitable method of connecting the inflation system and the interior volume such that the inflation system may introduce a fluid to the interior volume to inflate the rock anchor.

The interior volume may be substantially filled with the inflation fluid, thereby causing the rock anchor to expand (e.g., inflate) to an expanded configuration, in which the rock anchor has a second expanded shape. In the expanded configuration, the diameter of the rock anchor may be substantially the same as the diameter of the cavity such that the rock anchor is secured in the cavity. The expanded rock anchor (e.g., an outer wall) may be deformed by features of the cavity (e.g., features of wall(s) defining the cavity, an interior surface of the cavity or borehole) and may at least partially conform to irregularities in the cavity. When the rock anchor is deformed by features of the cavity, it may increase the structural engagement between the anchor and the mass.

At step 830, substantially all of the inflation fluid is drained from the rock anchor. In various embodiments, fluid, including the inflation fluid, is drained from the rock anchor using at least two passages in the rock anchor. In some embodiments, removing the inflation device from the rock anchor, for example in response to the rock anchor reaching the second configuration having the second shape, fluidly couples the interior volume to the ambient environment via the passages. In some embodiments, fluid flows out of the interior volume of the rock anchor via two or more passages, thereby draining the rock anchor faster than a single passage. In some embodiments, fluid flows out of the interior volume of the rock anchor via at least one passage and air flows into the interior volume of the rock anchor via at least one passage. This enables more fluid to be drained from the interior volume than conventional techniques, which may leave substantial amounts of fluid in the interior volume. In some embodiments, during the use of the rock anchor (e.g., while it is disposed in a borehole), groundwater or other fluid may be introduced into the interior volume. The passages allow this fluid to be drained from the rock anchor throughout the use of the inflation anchor. In various embodiments, the rock anchor maintains the second expanded shape after the inflation fluid has been drained from the rock anchor.

In some embodiments, draining is facilitated by fluidly coupling the interior volume to an ambient environment (e.g., by decoupling an inflation chuck). This allows free flow of fluid and air. In various embodiments, draining is assisted by gravity pulling fluid downward toward a passage. In other embodiments, a draining device may be used to remove the inflation fluid or other fluids from the rock anchor. For example, in some embodiments, a low pressure may be induced at one or more passages, for example using a vacuum device, to draw out fluid. Additionally or alternatively, a draining fluid such as air or another gas, may be introduced into a passage, thereby causing fluid to exit one or more passages. In some embodiments, air or another fluid may be purged from the interior volume using a fluid. For example, paint, lining fluid, or another fluid may be introduced into the interior volume, thereby causing air (or another fluid in the interior volume) to be displaced from interior volume. In the above examples, one or more passages may have to be vented to the ambient environment. In some embodiments, draining is a substantially isothermal process.

Figure 9:
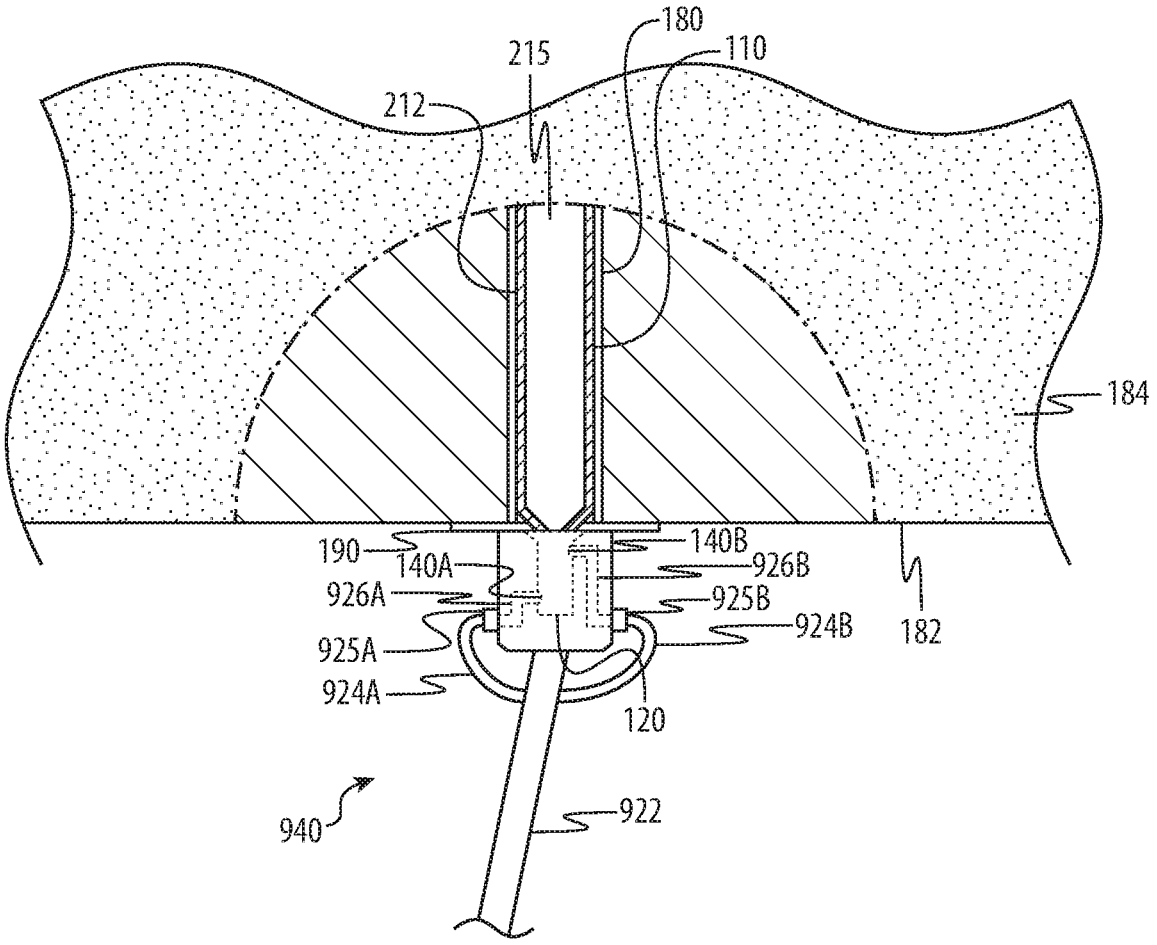
FIG. 9 illustrates a cutaway view of a rock anchor in an expanded configuration and disposed in a cavity and components of an inflation system interfacing with the rock anchor.

As discussed above, inflation and/or draining may be effectuated by an inflation system. FIG. 9 illustrates a cutaway view of the rock anchor 100 in the expanded configuration and disposed in a cavity 180 and components of an inflation system 940 interfacing with the rock anchor. The inflation system includes an inflation chuck 950 that is configured to interface with the rock anchor 100. As discussed above, in some embodiments, the inflation chuck 950 includes an opening configured to receive the bushing 120 of the rock anchor 100.

In various embodiments, the inflation system 940 is configured to introduce one or more inflation fluids into the interior volume 215 of the rock anchor 100. In some embodiments, the inflation system 940 is configured to drain inflation fluids from the interior volume 215. In some embodiments, the inflation system introduces and drains inflation fluids from the interior volume 215. The inflation system 940 may be configured to introduce multiple fluids to the interior volume 215 to effectuate inflation and/or draining. For example, the inflation system 940 may introduce a first fluid (e.g., an inflation fluid) into the interior volume 215 to inflate the rock anchor 100 and may introduce a second fluid (e.g., a draining fluid) into the interior volume to facilitate draining of the interior volume. In some embodiments, the second fluid displaces the first fluid and causes all or substantially all of the first fluid to drain from the interior volume.

In various embodiments, the multiple passages 140 (e.g., passages 140A and 140B) of the rock anchor 100 may be used to facilitate inflation and/or draining by the inflation system 940. The inflation chuck 950 may have multiple inflation paths (e.g., inflation paths 926A and 926B) to facilitate using multiple passages for inflation and/or draining. In some embodiments, for example, the inflation system 940 may introduce a first fluid (e.g., an inflation fluid) into the interior volume 215 via a first inflation path 926A and a first passage 140A to inflate the rock anchor 100. The inflation system 940 may introduce a second fluid (e.g., a draining fluid) into the interior volume via a second inflation path 926B and a second passage 140B to facilitate draining of the interior volume. In some embodiments, the inflation system 940 may drain the first fluid via the first passage 140A and the first inflation path 926A as it is displaced by the second fluid. In some embodiments, the inflation system 940 introduces the first fluid via the first passage 140A and the first inflation path 926A to inflate the rock anchor 100, and introduces the second fluid via the same passage and path. In some embodiments, the inflation system 940 drains the first fluid via the second passage 140B and the second inflation path 926B. In some embodiments, the first fluid may be drained using a vacuum device that introduces a low pressure at the second inflation path 926B. In other embodiments, the inflation system may introduce and/or drain the fluids via multiple passages 140 and/or inflation paths 926. In still other embodiments, separate paths (e.g., inflation paths 926) may be used for inflation and draining. The above examples are merely illustrative. In various embodiments, any combination of one or more passages may be used to introduce fluids to and/or drain fluids from the interior volume 215.

The inflation system 940 may include additional components such as supply lines 924A and 924B. In some embodiments, supply lines 924A and 924B are coupled to the first and second inflation paths 926A and 926B, for example by connectors 925A and 925B, respectively. The supply lines 924A and 924B may couple the inflation chuck 950A to other components of the inflation system 940, such as one or more pumps, supply reservoirs, or the like. In some embodiments, a boom 922 is coupled to the inflation chuck 950. The boom 92 may allow an operator of the inflation system 940 to more easily facilitate coupling of the inflation chuck 950 to the rock anchor 100. In some embodiments, supply lines 924A and 924B are at least partially disposed within the boom 922.

Figure 10:
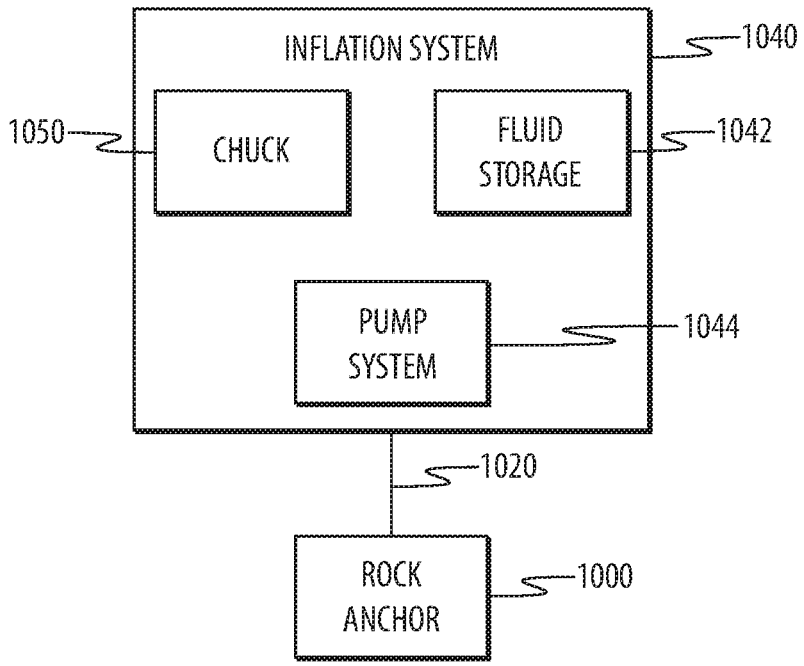
FIG. 10 is a simplified block diagram of an inflation system and a rock anchor.

FIG. 10 is a simplified block diagram of an inflation system 1040 and a rock anchor 1000. In various embodiments, the inflation system 1040 may have the same or similar functionality or components as other inflation systems discussed herein (e.g., the inflation system 940). Similarly, the rock anchor 100 may have the same or similar functionality or components as other rock anchors discussed herein (e.g., rock anchor 100). In one embodiment, the inflation system 1040 includes a chuck 1050, fluid storage 1042, and a pump system 1044. The inflation system 1040 may be coupled to the rock anchor 1000 via one or more connections 1020.

In various embodiments, the chuck 1050 is configured to interface with the rock anchor 1000, for example as described above with respect to FIG. 9. In some embodiments, the connections 1020 refer to the rock anchor 1000 being at least partially disposed in an opening of the chuck 1050 such that the chuck and inflate and/or drain the rock anchor. The chuck 1050 is discussed in more detail below with respect to FIGS. 11A-11E.

In some embodiments, the fluid storage 1042 maintains one or more fluids (e.g., inflation fluids, draining fluids, treatment agents, and the like) for use by the inflation system. Fluids may include one or more liquids, gasses, gels, or the like for use in treating, inflating and/or draining the rock anchor 1000. As discussed above, inflation fluids, such as inflation fluids, are fluids that are used to inflate the rock anchor 1000. In some embodiments, the inflation fluid is a liquid, such as water. Further, draining fluids may be used to facilitate draining of the rock anchor 1000, for example by displacing inflation fluids. In some embodiments, the draining fluid is a gas, such as air. Treatment agents may be used to perform treatment processes on the rock anchor 1000 before, during, and/or after the inflation process. For example, the treatment agents may include substances configured to create a coating and/or lining on the rock anchor 1000. Additionally or alternatively, treatment agents may be configured to inhibit corrosion, and may include a corrosion-inhibiting agent or some other type of treatment. The treatments of the rock anchor may result in improved performance, including reduced corrosion. In some embodiments, the treatment agent includes polyurethane. In various embodiments, the fluids discussed above may be combined as a single fluid with multiple uses. For example, an inflation fluid may include a treatment agent such that a treatment process may occur simultaneously with the inflation process. As another example, a draining fluid may include a treatment agent such that a treatment process may occur simultaneously with the draining process. As still another example, inflation fluids, treatment agents, and/or draining fluids may include one or more substances that are anti-corrosive in nature.

In various embodiments, the fluid storage 1042 includes one or more reservoirs, tanks, or the like to store and maintain the fluids. In some embodiments, the fluid storage 1042 may include storage for inflation fluids, draining fluids, and/or treatment agents that have been used in previous treatment, inflation, and/or draining processes. For example, the fluid storage 1042 may include storage for treatment and/or inflation fluids that have been used to treat and/or inflate a rock anchor 1000 and subsequently drained from the rock anchor 1000. In some embodiments, fluids used in inflation and/or draining are not maintained in the fluid storage 1042. For example, the pump system 1044 may use groundwater, air, or other substances present in the working environment as fluids without the inflation system storing or maintaining those fluids. Similarly, drained fluids may be transferred outside of the inflation system, for example to a disposal system.

In various embodiments, the pump system 1044 moves the fluids between fluid sources (e.g., the fluid storage 1042 or other sources) and the rock anchor 1000, for example via the chuck 1050. The pump system 1044 may include any device or combination of devices that include functionality for moving fluids, including one or more pumps. The pump system 1044 may also include functionality for pressurizing one or more fluids. In some embodiments, the pump system 1044 includes a first pump for moving inflation fluids and a second pump for moving draining fluids. In various embodiments, one or more of the pumps of the pump system 1044 are bi-directional, meaning that they can move fluids into the interior volume or drain fluids from the interior volume. For example, a pump may be configured to inflate the rock anchor 1000 by introducing an inflation fluid into the rock anchor 1000, and the same pump may be configured to drain the inflation fluid from the rock anchor 1000, for example by introducing a negative pressure. Alternatively, the pumps of the pump system 1044 may be one-directional, and may be plumbed using a valve system that reverses the pressure introduced by the pump system.

FIG. 10 illustrates an example embodiment of an inflation system 1040 and a rock anchor 1000. The modules and devices discussed with respect to FIG. 10 are examples, and are not meant to be limiting. In other embodiments, the inflation system 1040 may have different modules or devices for achieving the functionality discussed herein.

Figure 11A:
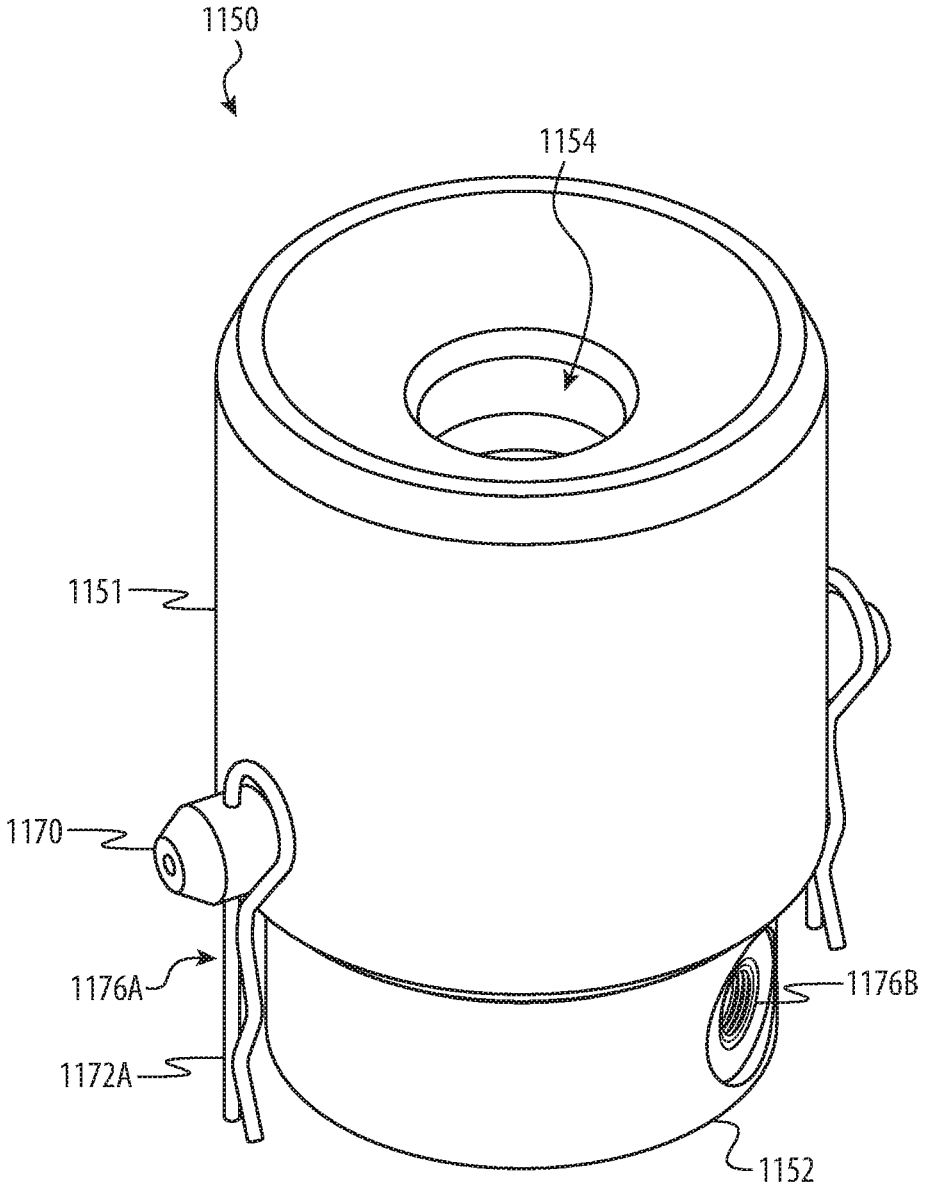
FIG. 11A illustrates an example inflation chuck.

FIG. 11A illustrates an example inflation chuck 1150. The inflation chuck 1150 may have the same or similar functionality or components as other inflation systems discussed herein (e.g., inflation chucks 750, 1050). The inflation chuck 1150 defines an opening 1154 that is configured to receive at least an end of a rock anchor, as discussed in more detail below with respect to FIGS. 11B-11E.

The inflation chuck 1150 further includes an inner housing 1152 and a housing cover 1151. In some embodiments, the housing cover 1151 is coupled to the inner housing 1152 and/or at least partially surrounds the inner housing 1152. In the embodiment shown in FIG. 11A, the housing cover 1151 fits over the inner housing 1152 and is releasably coupled to the inner housing 1152 by a retention member 1170. In various embodiments, the retention member 1170 passes through at least one orifice formed in the inflation chuck 1150, as is discussed in more detail below with respect to FIG. 11B. The retention member 1170 may be retained in the orifice by one or more retaining clips (e.g., retaining clips 1172A and 1172B). The retaining clips 1172A and/or 1172B may be removed to remove the retention member 1170 from the inflation chuck 1150.

The inner housing 1152 defines one or more external ports for coupling with an inflation system. The embodiments of FIGS. 11A-E includes two external ports 1176A and 1176B. In the embodiments shown, the external ports 1176A and 1176B are disposed substantially opposite one another for purposes of illustration. In various embodiments, the placement of the one or more external ports around the inner housing 1152 differs from what is shown in the figures. For example, the external ports may be disposed adjacent to one another or at different positions around the inner housing 1152. In some embodiments, the external ports may be placed on a different surface from what is shown. For example, the external ports may be defined through the bottom surface of the inflation chuck 1150 shown in FIG. 11B, or any other suitable location on the inflation chuck.

Figure 11B:
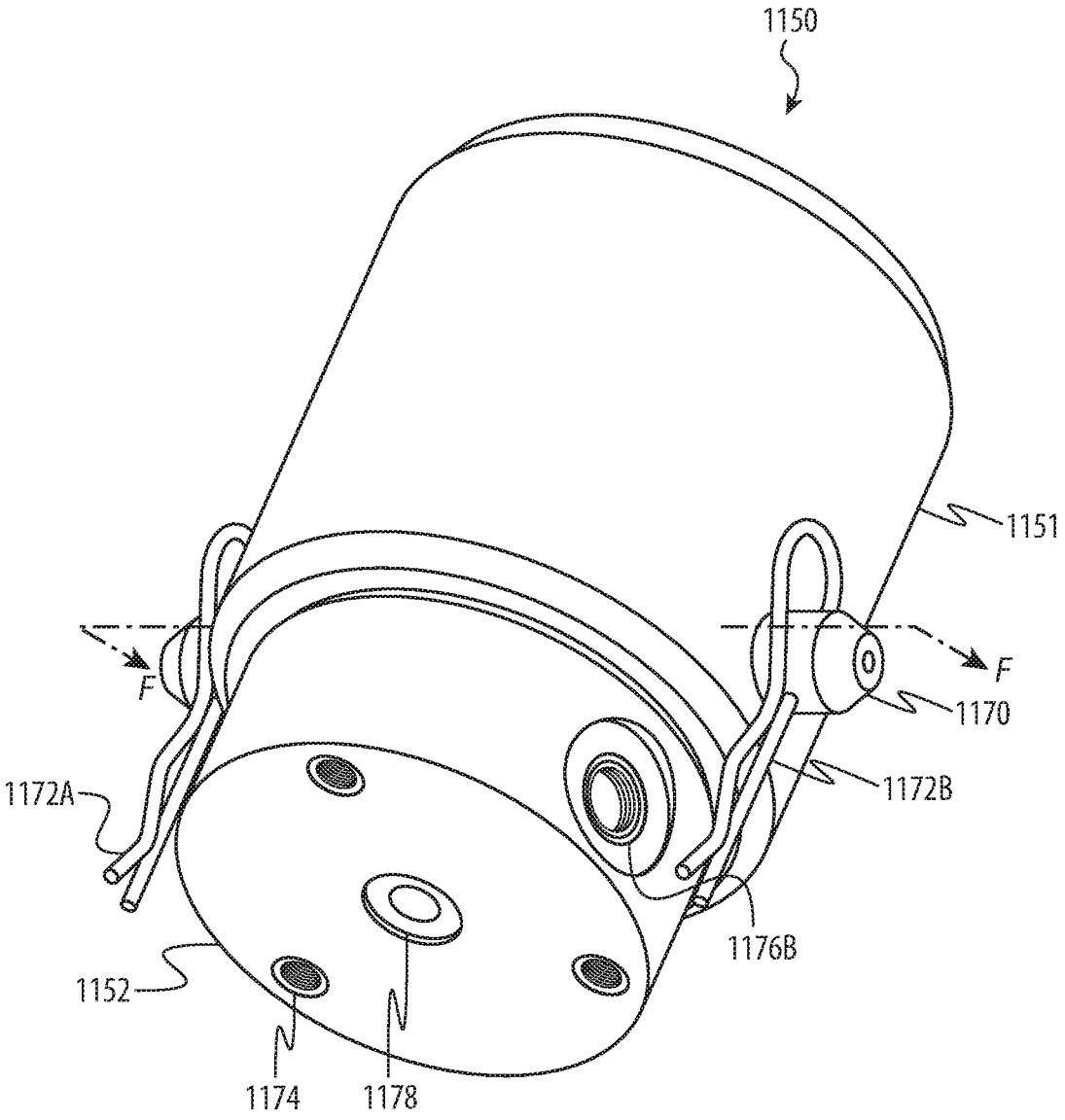
FIG. 11B illustrates an alternate view of the example inflation chuck of FIG. 11A.

FIG. 11B illustrates an alternate view of the example inflation chuck 1150 of FIG. 11A. As shown in FIG. 11B, the inflation chuck includes attachment receptacles 1174 for receiving attachment devices, for example from a boom of an inflation system (e.g., boom 922 discussed above). The inflation chuck 1160 further includes opening 1178A on a bottom surface of the inflation chuck 1150.

Figure 11C:
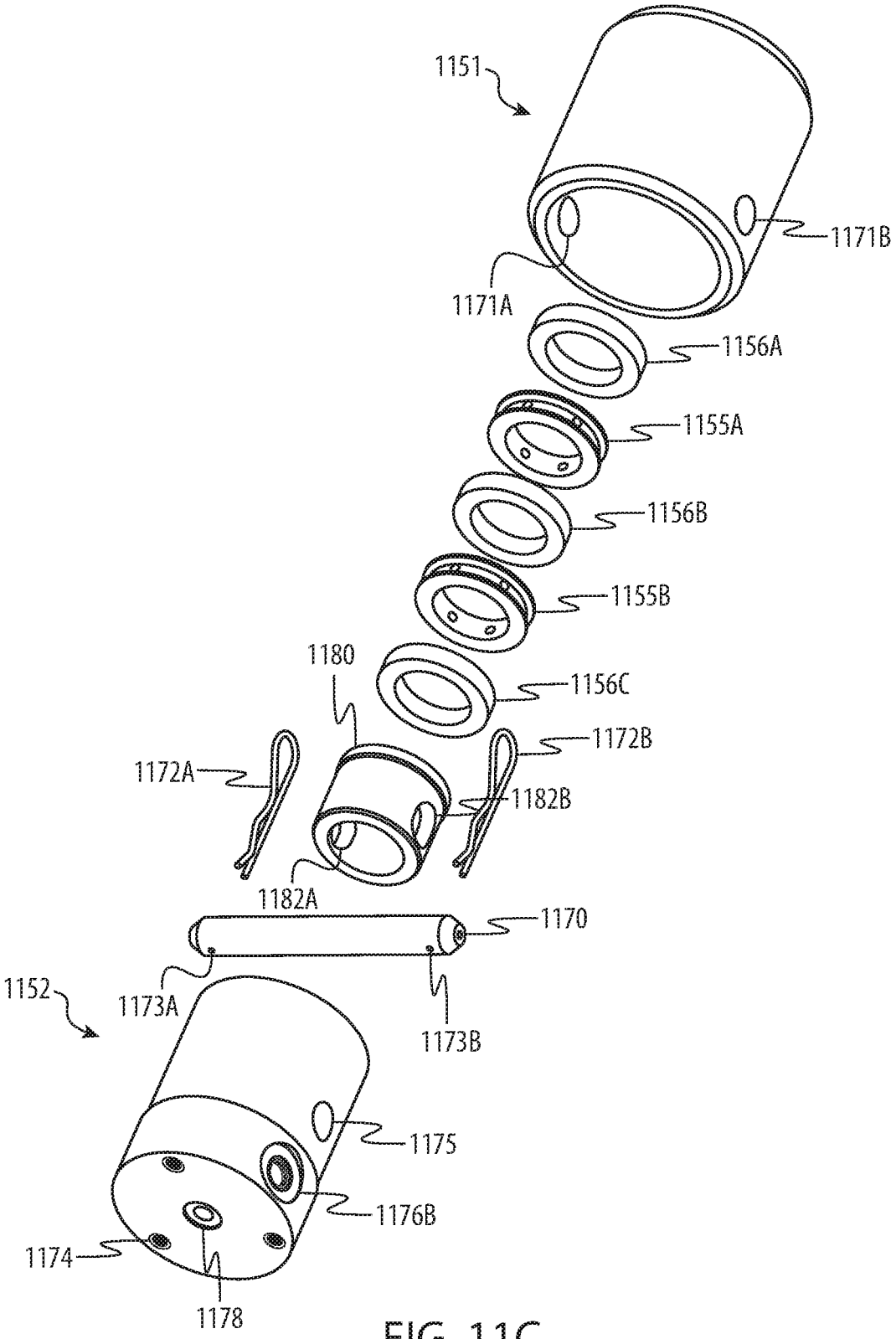
FIG. 11C illustrates an exploded view of the example inflation chuck of FIGS. 11A-11B.

FIG. 11C illustrates an exploded view of the example inflation chuck 1150 of FIGS. 11A-11B. The inflation chuck 1150 includes gaskets 1156A, 1156B, and 1156C, inflation rings 1155A and 1155B, and a retention sleeve 1180 that are disposed in the inner housing 1152 during normal operation of the inflation chuck, as discussed in more detail below with respect to FIGS. 11D and 11E.

As shown in FIG. 11C, the housing cover 1151 defines holes 1171A and 1171B, the inner housing 1152 defines hole 1175 and a second hole (not shown), and the retention sleeve 1180 defines holes 1182A and 1182B. The holes 1171, 1175, and 1182 form two orifices that define a pathway for the retention member 1170. The retention member 1170 is configured to be disposed in the orifices along the pathway, thereby releasably coupling the components of the inflation chuck. The retaining clips 1172A and 1172B may be disposed in holes 1173A and 1173B to retain the retention member in the orifice. The gaskets 1156, the inflation rings 1155, and the retention sleeve 1180 are secured in the inner housing 1152 by the housing cover 1151.

Figure 11D:
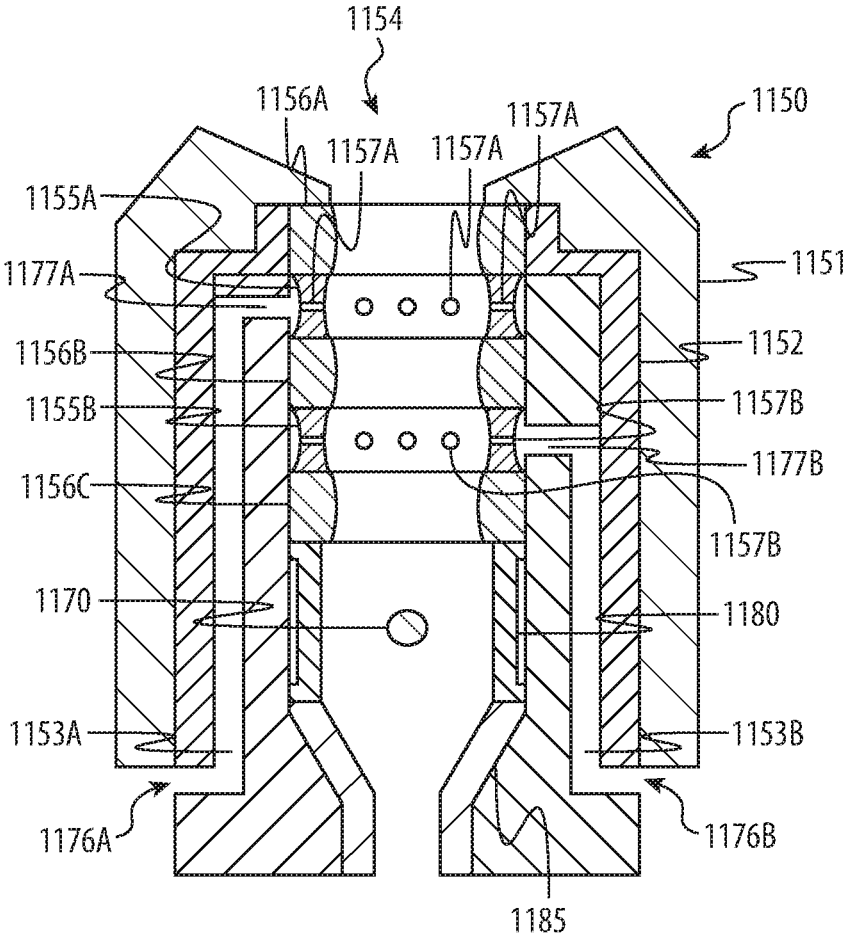
FIG. 11D is a cross-section of the example inflation chuck taken through section line F-F of FIG. 11B.

FIG. 11D is a cross-section of the inflation chuck 1150 taken through section line F-F of FIG. 11B. FIG. 11D illustrates the inflation rings 1155A-B, the gaskets 1156A-C and the retention sleeve 1180 disposed in the inner housing 1152 and secured by the housing cover 1151 and the retention member 1170. The housing cover 1151, the gaskets 1156A-C, the inflation rings 1155A-B, the retention sleeve 1180, and/or an insert 1185 cooperate to form the opening 1154 for receiving a rock anchor.

In some embodiments, the inflation chuck 1150 defines multiple inflation paths 1153A and 1153B for fluidly coupling the opening 1154 to the rest of the inflation system. Each inflation path may include one or more internal ports (e.g., internal ports 1177A and 1177B) into the opening 1154. In various embodiments, the inflation paths 1153A-B are fluidly isolated from one another. In some embodiments, the inflation paths 1153A-B are defined in the inner housing 1152. The inflation chuck 1150 may include any suitable number of inflation paths.

The inflation rings 1155A and 1155B define one or more openings 1157A and 1157B. In some embodiments, the inflation paths 1153A and 1153B fluidly couple the opening 1154 to the rest of the inflation system via the external ports 1176A and 1176B, the internal ports 1177A and 1177B, and the openings 1157A and 1157B in the inflation rings 1155A and 1155B, respectively. The gaskets 1156A-C are configured to form a seal (e.g., a watertight seal, an airtight seal, etc.) around the inflation rings 1155A and B when a rock anchor is disposed in the opening 1154, as discussed in more detail below with respect to FIG. 11E.

Figure 11E:
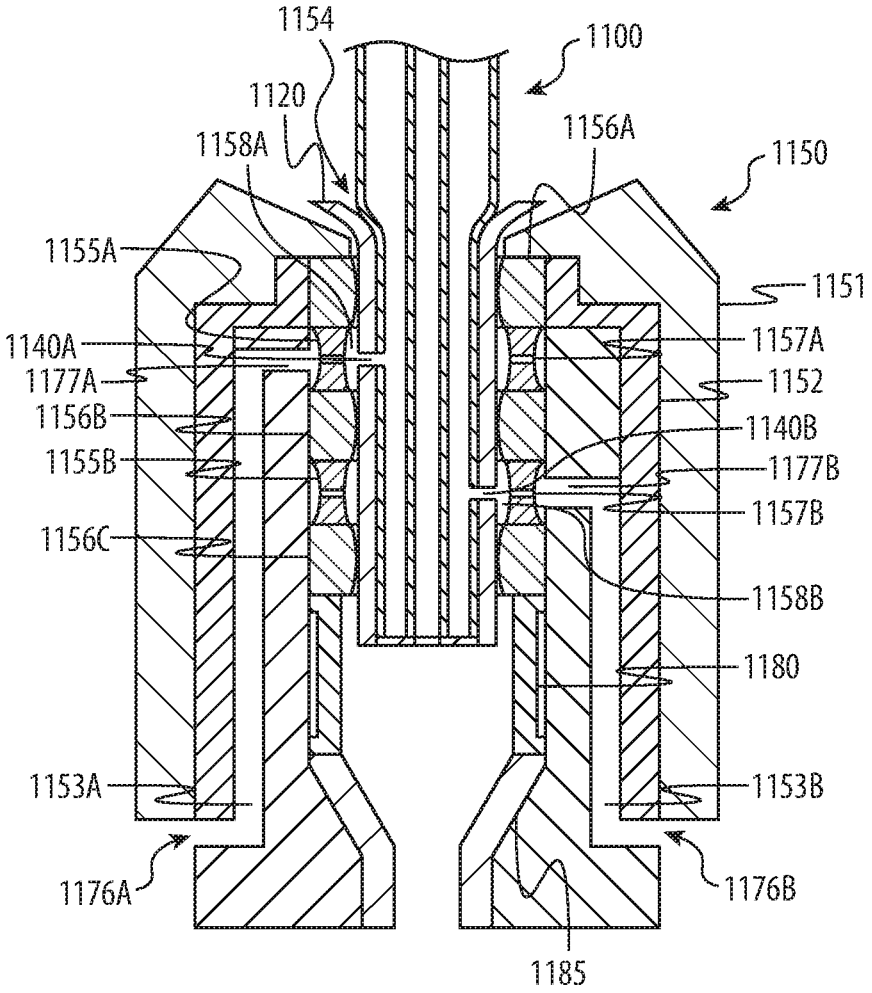
FIG. 11E is a cross-section of the inflation chuck as in FIG. 11D with an end of a rock anchor disposed therein.

FIG. 11E is a cross-section of the inflation chuck 1150 as in FIG. 11D with a rock anchor 1100 disposed therein. The rock anchor 1100 may have the same or similar functionality or components as other rock anchors discussed herein (e.g., rock anchors 100, 900). As discussed above, an upper portion of the bushing 1120 of the rock anchor may interface with the housing cover 1151 to establish a maximum insertion position for the rock anchor.

In various embodiments, the internal ports 1177A and 1177B are configured to fluidly couple with the passages 1140A and 1140B of the rock anchor to facilitate inflation and/or draining. As noted above, the gaskets 1156A-C are configured to form a seal (e.g., a watertight seal, an airtight seal, etc.) around the inflation rings 1155A and B when the rock anchor 1100 is disposed in the opening 1154. The gasket 1156A interfaces with the rock anchor 1100 (e.g., the bushing 1120), the housing cover 1151, the inner housing 1152, and the inflation ring 1155A to form a seal. The gasket 1156B interfaces with the rock anchor 1100, the inflation rings 1155A and B and the inner housing 1152 to form a seal. The gasket 1156C interfaces with the rock anchor 1100, the inflation ring 1155B, the retention sleeve 1180, and the inner housing 1152 to form a seal.

In various embodiments, the gaskets 1156A-C, the inflation rings 1155A-B, and the rock anchor 1100 may cooperate to form one or more voids 1158A and B around each inflation ring. For example, the gaskets 1156A and B may cooperate with the bushing 1120 and the inflation ring 1155A to form a void 1158A. Similarly, the gaskets 1156B and C may cooperate with the bushing 1120 and the inflation ring 1155B to form a void 1158B. In various embodiments, the only openings in the voids 1158A-B are the openings 1157A-B and the passages 1140A-B such that sealed passages exist between the inflation paths 1153A-B and the interior volume 1115 of the rock anchor, thereby fluidly coupling the inflation paths to the interior volume.

In some embodiments, one or more of the gaskets 1156A-C are configured to fluidly isolate the voids 1158A and 1158B such that there are two fluidly isolated passages into the interior volume 1115. For example, the gasket 1156A-C may interface with the rock anchor 1100, the inflation rings 1155A and B and the inner housing 1152 to fluidly isolate the voids 1158A and 1158B from one another.

In the embodiments of FIGS. 11A-E, the inflation chuck 1150 is shown as having two inflation rings and three gaskets. In other embodiments, the inflation chuck 1150 may have any number of inflation rings and gaskets. For example, the inflation chuck 1150 may include three inflation rings and four gaskets arranged in a stack as in the embodiments shown herein. Similarly, the rock anchor 1100 shown in FIG. 11E includes two passages 1140A and 1140B. In other embodiments, the rock anchor may include any number of passages arranged along the rock anchor 1100. In some embodiments, the number and positioning of the passages corresponds to the number of inflation rings. In some embodiments, there may be more than one passage configured to align with an inflation ring. For example, a rock anchor may include two, three, or more passages that align with a single inflation ring.

In some embodiments, the inflation chuck 1150 may be compatible with multiple different types of rock anchors. In some embodiments, the inflation chuck 1150 may be configured to inflate rock anchors with different numbers of passages, different lengths of bushings, and the like. For example, a rock anchor with a single passage, such as a traditional rock anchor, may be disposed in the opening 1154 such that the single passage aligns with an internal port in the inflation chuck (e.g., internal port 1177A and passage 1140A) and the passage couples an interior volume of the rock anchor with an inflation path (e.g., inflation path 1153) for inflating and/or draining the rock anchor. One or more additional inflation paths of the inflation chuck 1150 may be sealed or blocked, for example by virtue of the fact that no opening in the rock anchor is aligned with the internal port of the inflation path. Said another way, the bushing of the rock anchor may interface with one or more gaskets to form a seal.

As noted above, in various embodiments, the positioning of the passages 1140A and 1140B may vary based on the characteristics of the inflation chuck 1150. For example, the distance between the passages may be substantially equal to a distance between two inflation rings such that the passages align with both inflation rings. Similarly, in various embodiments, other dimensions of the rock anchor 1100 may be changed. For example, as shown in FIG. 11E, the bushing 1120 may be elongated compared to, for example, inflation chucks with one inflation ring.

Figure 12:
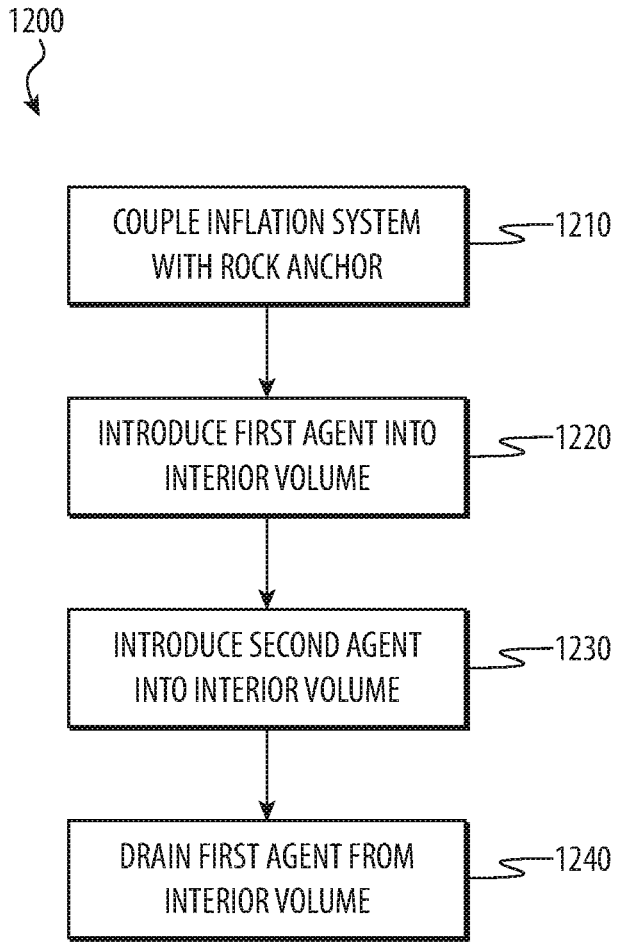
FIG. 12 is a simplified flow chart depicting an example process for inflating and draining a rock anchor.

FIG. 12 is a simplified flow chart depicting an example process 1200 for inflating and draining a rock anchor. At step 1210, a rock anchor is coupled with an inflation system, such as described herein. For example, an inflation chuck may receive a bushing of the rock anchor and fluidly couple first and second inflation paths of the inflation chuck with the interior volume of the rock anchor via passages in the rock anchor. The rock anchor may be at least partially inserted in a cavity, such as a borehole in a rock structure, in an unexpanded configuration, in which the rock anchor has a first shape, such as a "folded tube" shape. In the unexpanded configuration, the rock anchor may have a diameter that is less than the diameter of the cavity.

At step 1220, a first fluid is introduced into the interior volume of the rock anchor. In some embodiments, the first fluid is an inflation fluid. In some embodiments, the first fluid includes a treatment agent for performing a treatment process during inflation. For example, a pump system of the inflation system may move a fluid through the first inflation path and a first passage and into the interior volume. The interior volume may be substantially filled with the inflation fluid, thereby causing the rock anchor to expand (e.g., inflate) to an expanded configuration, in which the rock anchor has a second expanded shape. In the expanded configuration, the diameter of the rock anchor may be substantially the same as the diameter of the cavity such that the rock anchor is secured in the cavity. The expanded rock anchor (e.g., the anchor body) may be deformed by features of the cavity (e.g., features of wall(s) defining the cavity) and may at least partially conform to irregularities in the cavity. When the rock anchor is deformed by features of the cavity, it may increase the structural engagement between the anchor and the mass.

At step 1230, a second fluid is introduced into the interior volume. At step 1240, the first fluid is drained (e.g., removed) from the interior volume. For example, the pump system (e.g., a vacuum device) may introduce a negative pressure in the inflation system to cause the first fluid to flow out of the interior volume. In various embodiments, introducing the second fluid into the interior volume displaces the first fluid and allows the first fluid to drain from the interior volume. In some embodiments, removing the first fluid from the interior volume without replacing the first fluid being with the second fluid would result in the rock anchor returning to the unexpanded configuration. Therefore, in some embodiments, introducing the second fluid allows the first fluid to be removed from the interior volume without causing the rock anchor to return to the unexpanded configuration.

In some embodiments, introducing the second fluid into the interior volume causes the first fluid to drain from the interior volume. For example, introducing the second fluid may include introducing pressurized air into the interior volume, which displaces the first fluid and causes it to exit the interior volume. In some embodiments, removing the first fluid causes the second fluid to be introduced to the volume. For example, in embodiments where removing the first fluid includes introducing a negative pressure in the inflation system, removal of the first fluid may cause the second fluid to flow into the interior volume. In some embodiments, introducing the second fluid and/or removing the first fluid may include coupling the interior volume to an ambient environment. For example, in embodiments where removing the first fluid includes introducing a negative pressure in the inflation system to remove the first fluid using a first passage, a second passage may be coupled to the ambient environment to introduce a second fluid (e.g., air) into the interior volume.

In various embodiments, multiple passages in the rock anchor and/or inflation paths in the inflation chuck are used to introduce the second fluid and drain the first fluid. For example, the first fluid may be removed using a first path and a first passage, and the second fluid may be introduced using a second path and a second passage. The passage through which the first fluid is removed may or may not be the same passage through which the first fluid is introduced. In some instances, the first fluid is introduced using a first path and a first passage, the second fluid is introduced using the first path and the first passage, and the first fluid is removed using a second path and a second passage. In some instances, the first fluid is introduced using a first path and a first passage, the second fluid is introduced using a second path and a second passage, and the first fluid is removed using a third path and a third passage. In various embodiments, steps 1230 and 1240 may occur in different orders. In various embodiments, steps 1230 and 1240 may overlap, either partially or completely. In some embodiments, steps 1230 and 1240 initiate at substantially the same time.

In various embodiments, all, substantially all, or some lesser amount of the first fluid is removed from the interior volume. Following the draining of the first fluid from the interior volume, the process may be complete, and the inflation system may be decoupled from the rock anchor. In some embodiments, the second fluid is removed from the interior volume, either by the inflation system or via other means. In various embodiments, the rock anchor maintains the second expanded shape after the first and/or second fluids have been removed from the rock anchor.

As noted above, many embodiments described herein reference a rock anchor and rock anchor inflation system. It may be appreciated, however, that this is merely one example; other configurations, implementations, and constructions are contemplated in view of the various principles and methods of operations—and reasonable alternatives thereto—described in reference to the embodiments described above.

One may appreciate that although many embodiments are disclosed above, that the operations and steps presented with respect to methods and techniques described herein are meant as exemplary and accordingly are not exhaustive. One may further appreciate that alternate step order or fewer or additional operations may be required or desired for particular embodiments.

Although the disclosure above is described in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the embodiments of the invention, whether or not such embodiments are described and whether or not such features are presented as being a part of a described embodiment. Thus, the breadth and scope of the present invention should not be limited by any of the above-described exemplary embodiments but is instead defined by the claims herein presented.

What is claimed is:

1. A method for expanding and draining an expandable rock anchor, comprising:

inserting, at least partially into a borehole, a rock anchor having a first shape having a first diameter that is less than a diameter of the borehole, the rock anchor defining first and second openings to an interior volume of the rock anchor;

fluidly coupling an inflation system to the interior volume of the rock anchor using an inflation chuck;

introducing, using the inflation system, a first fluid into the interior volume, thereby causing the rock anchor to expand to a second shape having a second diameter that is greater than the first diameter and substantially equal to the diameter of the borehole;

introducing, by the inflation system, a second fluid into the interior volume through the first opening, thereby displacing the first fluid and causing substantially all of the first fluid to flow out of the interior volume through the second opening, wherein:

the rock anchor maintains the second shape following the draining of substantially all of the first fluid from the interior volume; and an exterior surface of the expanded rock anchor engages with an interior surface of the borehole, thereby retaining the rock anchor in the borehole.

2. The method of claim 1, wherein:

the first fluid comprises an inflation fluid; and the second fluid comprises air.

3. The method of claim 1, wherein:

the first opening is positioned a first distance from an end of the rock anchor; and the second opening is positioned a second distance from the end of the rock anchor less than the first distance.

4. The method of claim 1, wherein an outer wall of the rock anchor is deformed by the interior surface of the borehole.

5. An inflation chuck for a rock anchor inflation system comprising:

a housing defining:

a cavity configured to receive an end of a rock anchor that is configured to be inserted into a borehole and inflated to engage with an interior surface of the borehole;

a first inflation path configured to be fluidly coupled to a first passage into an interior volume of the rock anchor; and a second inflation path configured to be fluidly coupled to a second passage into the interior volume of the rock anchor;

a housing cover coupled to and at least partially surrounding the housing;

a retention sleeve disposed in the cavity;

a first inflation ring configured to be disposed around the rock anchor, the first inflation ring defining one or more first features configured to fluidly couple the first inflation path to the interior volume;

a second inflation ring configured to be disposed around the rock anchor, the second inflation ring defining one or more second features configured to fluidly couple the second inflation path to the interior volume;

a first gasket disposed between the first inflation ring and the second inflation ring and configured to extend around the rock anchor and form a seal between the first passage and the second passage;

a second gasket disposed between the first inflation ring and a surface of the housing cover; and a third gasket disposed between the second inflation ring and the retention sleeve.

6. The inflation chuck of claim 5, wherein the first, second, and third gaskets are disposed in the cavity and configured to interface with the housing.

7. The inflation chuck of claim 5, further comprising:

a retention member disposed in an orifice defined by one or more holes in the housing cover, one or more holes in the retention sleeve, and one or more holes in the housing, wherein the retention member is configured to releasably couple the housing cover to the housing.

8. The inflation chuck of claim 7, further comprising at least one retaining clip configured to retain the retention member in the orifice.

9. The inflation chuck of claim 5, wherein the housing further defines:

a first external port fluidly coupled to the first inflation path and configured to fluidly couple the first inflation path to a first pump;

a second external port fluidly coupled to the second inflation path and configured to fluidly couple the second inflation path to a second pump.

10. The inflation chuck of claim 9, wherein:

the first pump is configured to pump a liquid; and the second pump is configured to pump a gas.

11. An inflation system for a rock anchor comprising:

a pump system configured to fluidly couple to an interior volume of the rock anchor to inflate and drain the rock anchor; and an inflation chuck configured to interface with the rock anchor and fluidly couple the interior volume of the rock anchor to the pump system, the inflation chuck defining:

a cavity configured to receive an end of the rock anchor;

a first inflation path configured to be fluidly coupled to a first passage into the interior volume of the rock anchor; and a second inflation path configured to be fluidly coupled to a second passage into the interior volume of the rock anchor, wherein:

the inflation chuck comprises:

a first inflation ring defining one or more first features configured to form part of the first passage into the interior volume of the rock anchor; and a second inflation ring defining one or more second features configured to form part of the second passage into the interior volume of the rock anchor; and the pump system is configured to:

introduce a first fluid into the interior volume to inflate the rock anchor; and introduce a second fluid into the interior volume to facilitate draining of the first fluid from the rock anchor.

12. The inflation system of claim 11, wherein the pump system is configured to:

introduce the first fluid into the interior volume via the first inflation path and the first passage;

introduce the second fluid into the interior volume via the second inflation path and the second passage; and drain the first fluid from the interior volume via the first inflation path and the first passage.

13. The inflation system of claim 12, wherein:

the first fluid comprises a pressurized inflation fluid; and the second fluid comprises air.

14. The inflation system of claim 12, wherein the first fluid comprises a treatment agent configured to inhibit corrosion of the rock anchor.

15. The inflation system of claim 11, wherein the rock anchor comprises:

an elongate anchor body configured to be at least partially disposed in a rock cavity that extends from a surface of a rock structure into the rock structure, the elongate anchor body comprising a sidewall that extends along a length of the elongate anchor body, the sidewall defining:

a first opening that extends through the sidewall; and a second opening that extends through the sidewall; and a bushing disposed around the elongate anchor body and configured to interface with a washer disposed around the elongate anchor body, the bushing defining:

a third opening that substantially aligns with the first opening in the elongate anchor body, the first and third openings forming part of the first passage into the interior volume of the rock anchor; and a fourth opening that substantially aligns with the second opening in the elongate anchor body, the second and fourth openings forming part of the second passage into the interior volume of the rock anchor.

16. The inflation system of claim 15, wherein:

the elongate anchor body has a first diameter in a first configuration;

the interior volume of the elongate anchor body is configured to receive the first fluid via at the least one of the first or second openings, thereby causing the elongate anchor body to expand to a second expanded configuration in which the elongate anchor body has a second diameter greater than the first diameter; and in the second expanded configuration:

an exterior surface of the sidewall of the elongate anchor body is configured to engage with an interior surface of the rock cavity, thereby retaining the elongate anchor body in the rock cavity;

the bushing is configured to exert a force on the washer, thereby causing the washer to exert a corresponding force on the surface of the rock structure; and the first and second passages facilitate substantially complete draining of the interior volume.

17. The inflation system of claim 11, wherein the inflation chuck further comprises a gasket disposed between and forming a seal between the first and second passages.

18. The inflation system of claim 17, wherein:

the gasket is a first gasket and disposed on a first side of the first inflation ring and a second side of the second inflation ring; and the inflation chuck further comprises:

a second gasket disposed on a third side opposite the first side of the first inflation ring;

a third gasket disposed on a fourth side opposite the second side of the second inflation ring.

* * * * *